US006783087B2

(12) United States Patent
Aoki et al.

(10) Patent No.: US 6,783,087 B2
(45) Date of Patent: Aug. 31, 2004

(54) FUEL INJECTOR

(75) Inventors: Fumiaki Aoki, Hoi-gun (JP); Nobuo Imatake, Kariya (JP); Kimitaka Saito, Nagoya (JP); Kenji Kanehara, Toyohashi (JP); Akinori Harada, Toyohashi (JP)

(73) Assignees: Nippon Soken, Inc. (JP); Denso Corporation (JP)

( * ) Notice: Subject to any disclaimer, the term of this patent is extended or adjusted under 35 U.S.C. 154(b) by 223 days.

(21) Appl. No.: 10/118,313

(22) Filed: Apr. 9, 2002

(65) Prior Publication Data

US 2002/0170987 A1 Nov. 21, 2002

(30) Foreign Application Priority Data

Apr. 9, 2001 (JP) ..... 2001-110430
Feb. 27, 2002 (JP) ..... 2002-052097

(51) Int. Cl.[7] ..... B05B 1/00

(52) U.S. Cl. ..... 239/596; 239/103; 239/121; 239/419; 239/433; 239/552; 239/584; 239/585.1

(58) Field of Search ..... 239/103, 104, 239/120–122, 419, 419.3, 419.5, 428.5, 433, 533.2, 533.3, 533.8, 533.9, 533.12, 543, 548, 522, 491, 494, 497, 596, 584, 585.1, 585.4, 585.5

(56) References Cited

U.S. PATENT DOCUMENTS 3,223,331 A * 12/1965 Baker ..... 239/103
4,699,323 A * 10/1987 Rush et al. ..... 239/543
5,174,505 A * 12/1992 Shen ..... 239/585.1
5,395,050 A * 3/1995 Nowak et al. ..... 239/121
5,636,796 A * 6/1997 Oguma ..... 239/596
5,662,277 A * 9/1997 Taubitz et al. ..... 239/585.4
5,826,804 A * 10/1998 Reiter et al. ..... 239/585.1
5,924,634 A * 7/1999 Arndt et al. ..... 239/596
6,170,763 B1 * 1/2001 Fuchs et al. ..... 239/596

FOREIGN PATENT DOCUMENTS

| | | |
|---|---|---|
| JP | 8-277763 | 10/1996 |
| JP | 9-310651 | 12/1997 |
| JP | 2000-234578 | 8/2000 |

* cited by examiner

*Primary Examiner*—Steven J. Ganey
(74) *Attorney, Agent, or Firm*—Nixon & Vanderhye PC

(57) ABSTRACT

An injector has an orifice plate formed with plural orifices. At a radially outward position of the orifice plate is disposed a wall at least partially. It is preferable that the wall be disposed at a lower position in the direction of gravity. In the wall is formed a guide hole toward an area on the orifice plate where a strong negative pressure is developed. A portion of fuel injected from the injector adheres as adhered fuel to the orifice plate or the wall. Under the action of a negative pressure on the orifice plate the guide hole sucks in the adhered fuel and returns it onto the surface of the orifice plate. The adhered fuel flows from the wall onto the surface of the orifice plate and again joins a fuel jet injected from the orifices. By utilizing a negative pressure developed near the plural orifices, the adhered fuel can be recovered and again injected. Consequently, it is possible to decrease the amount of adhered fuel.

44 Claims, 30 Drawing Sheets

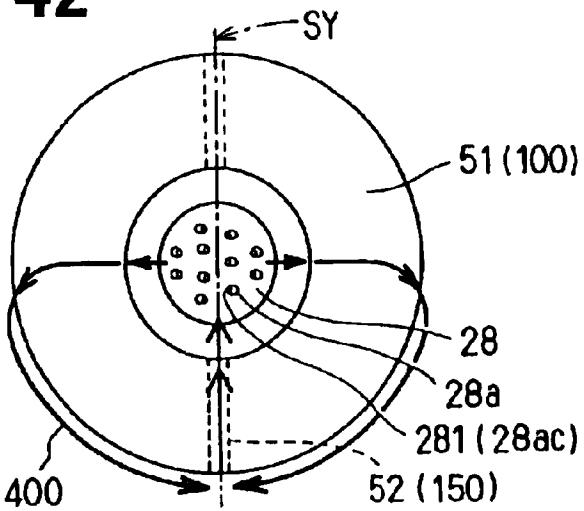
FIG. 40
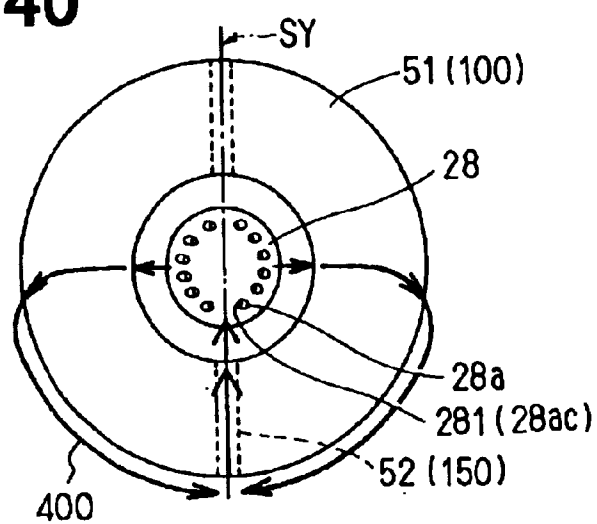
FIG. 41
FIG. 42
FIG. 43

FUEL INJECTOR

CROSS REFERENCE TO RELATED APPLICATION

This application is based on Japanese Patent Applications No. 2001-110430 filed on Apr. 9, 2001 and No. 2002-52097 filed on Feb. 27, 2002 the contents of which are incorporated herein by reference.

BACKGROUND OF THE INVENTION

1. Field of the Invention

The present invention relates to an injector for fuel injection.

2. Description of Related Art

An injector for fuel injection attached to an intake pipe of an internal combustion engine is known. For improving engine performance and for purifying exhaust gas, the injector is required to atomize fuel which is injected.

JP-A-08-277763 and JP-A-09-310651 disclose nozzle hole plates (also called orifice plates) formed with fine nozzle holes (also called orifices). According to these conventional techniques, fuel is injected from the orifices and is atomized. In each of these constructions, consideration is given to the flow of fuel upstream with respect to the orifice plate which contributes to the atomization of fuel. However, due consideration is not given to the path which the fuel should follow after injection. For example, in the case where the flow velocity of engine intake air is high, the spread of spray is partially obstructed and there is a fear that a portion of fuel may adhere to a tip portion of the injector and stay there as a drop. Further, Upstream the orifice plate there is formed a dead space between the plate and a valve member, so that the fuel staying in the dead space may leak out to the underside of the orifice plate and form a drop under the action of an intake negative pressure.

The adhered fuel gives rise to an undesirable difference between a target fuel quantity preset by a controller and an actual fuel quantity fed actually to a combustion chamber. Such a difference causes a deficient engine output, a lowering of response characteristic, and an increase of undesirable exhaust gas components.

SUMMARY OF THE INVENTION

It is an object of the present invention to provide an injector which can decrease the amount of fuel adhered to a tip portion of the injector.

It is another object of the present invention to provide an injector wherein the amount of adhered fuel does not increase even if the fuel is atomized to a high degree.

It is a further object of the present invention to provide an injector which can recover fuel adhered to its tip portion and can inject the recovered fuel.

According to a first feature of the present invention, the injector has an orifice plate formed with orifices. A highly atomized fuel is injected from the orifices. A portion of the fuel adheres to a tip portion of the injector. Downstream the injector orifice plate is formed a negative pressure region as the fuel is injected from the orifices. This region is designated a negative pressure forming section. The injector is provided with a recovery section. The recovery section conducts the adhered fuel toward outlets of the orifices by utilizing a negative pressure developed in the negative pressure forming section. By the recovery section there occurs a flow of adhered fuel toward the orifices' outlets.

The adhered fuel flows through the recovery section and is returned to a main jet formed from the orifices. As a result, an increase in the amount of fuel adhered to the injector tip is suppressed. There may be adopted a construction wherein plural orifices are formed in an orifice plate so as to be inclined divergently from a valve step of the injector. Such a divergent inclination permits utilizing a negative pressure developed at the injector tip. Plural orifices may be arranged so as to cross the orifice plate in the diametrical direction. For example, the orifices may be arranged in plural rows or in plural rings.

When fuel is injected from the orifices, a negative pressure is developed on the orifice plate, which is based on direction of fuel injection. This negative pressure is conducted radially outwards along the upper surface of the orifice plate. Consequently, there is formed an air stream flowing inwards from a radially outside of the orifice plate. The adhered fuel flows along this air stream.

The recovery section may be provided with a wall surface extending from the underside of the orifice plate downstream. The wall surface is disposed outside and near a circumscribed circle of outlet-side openings of the plural orifices. Fuel adhered to the wall surface is conducted toward the orifices' outlets under the action of a negative pressure developed in the negative pressure forming section. The wall surface may be circular or elliptic, or it may be formed by plural walls. The wall surface stabilizes the generation of a negative pressure in the negative pressure forming section and provides a path for the flow of adhered fuel.

The recovery section may be provided with a passage for radially conducting the negative pressure developed in the negative pressure forming section. Through this passage the adhered fuel flows toward the negative pressure forming section and thus the recovery of the adhered fuel is promoted.

According to another feature of the present invention, the injector has an orifice plate provided at a tip thereof and formed with orifices for the injection of fuel and also has a catch member for catching fuel adhered to the tip of the injector. The catch member forms a path for allowing the adhered fuel to flow toward an upper surface of the orifice plate. Consequently, the adhered fuel is returned to the orifice plate and is injected again.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

FIG. 40 is a plan view of a tip of an injector according to an eighteenth embodiment of the present invention;

FIG. 41 is a plan view of a tip of an injector according to a nineteenth embodiment of the present invention;

FIG. 42 is a plan view of a tip of an injector according to a twentieth embodiment of the present invention;

FIG. 43 is a plan view of a tip of an injector according to a twenty-first embodiment of the present invention;

DETAILED DESCRIPTION OF PREFERRED EMBODIMENTS

First Embodiment

Figure 1:
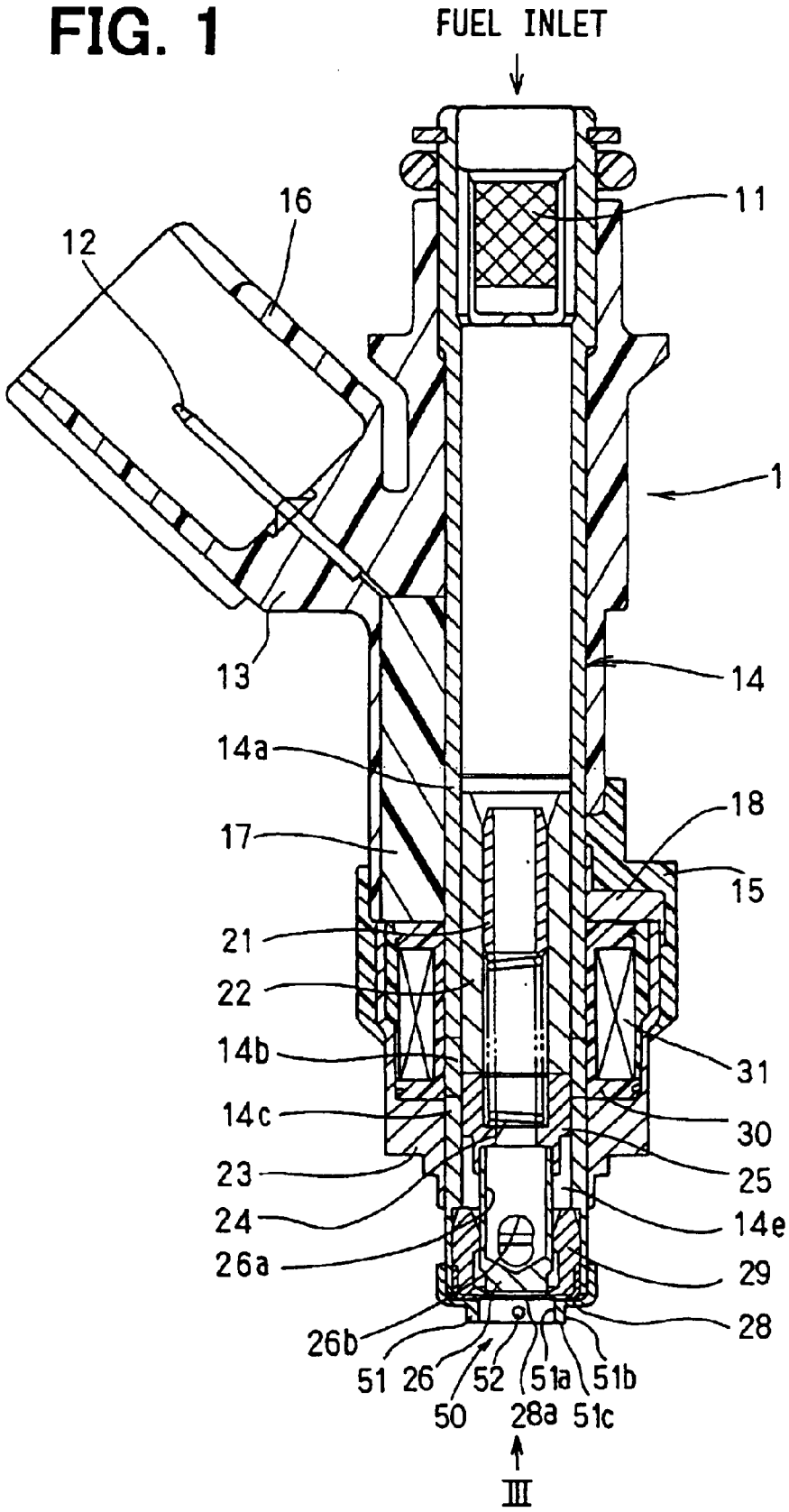
FIG. 1 is a sectional view of an injector according to a first embodiment of the present invention.
Figure 2:
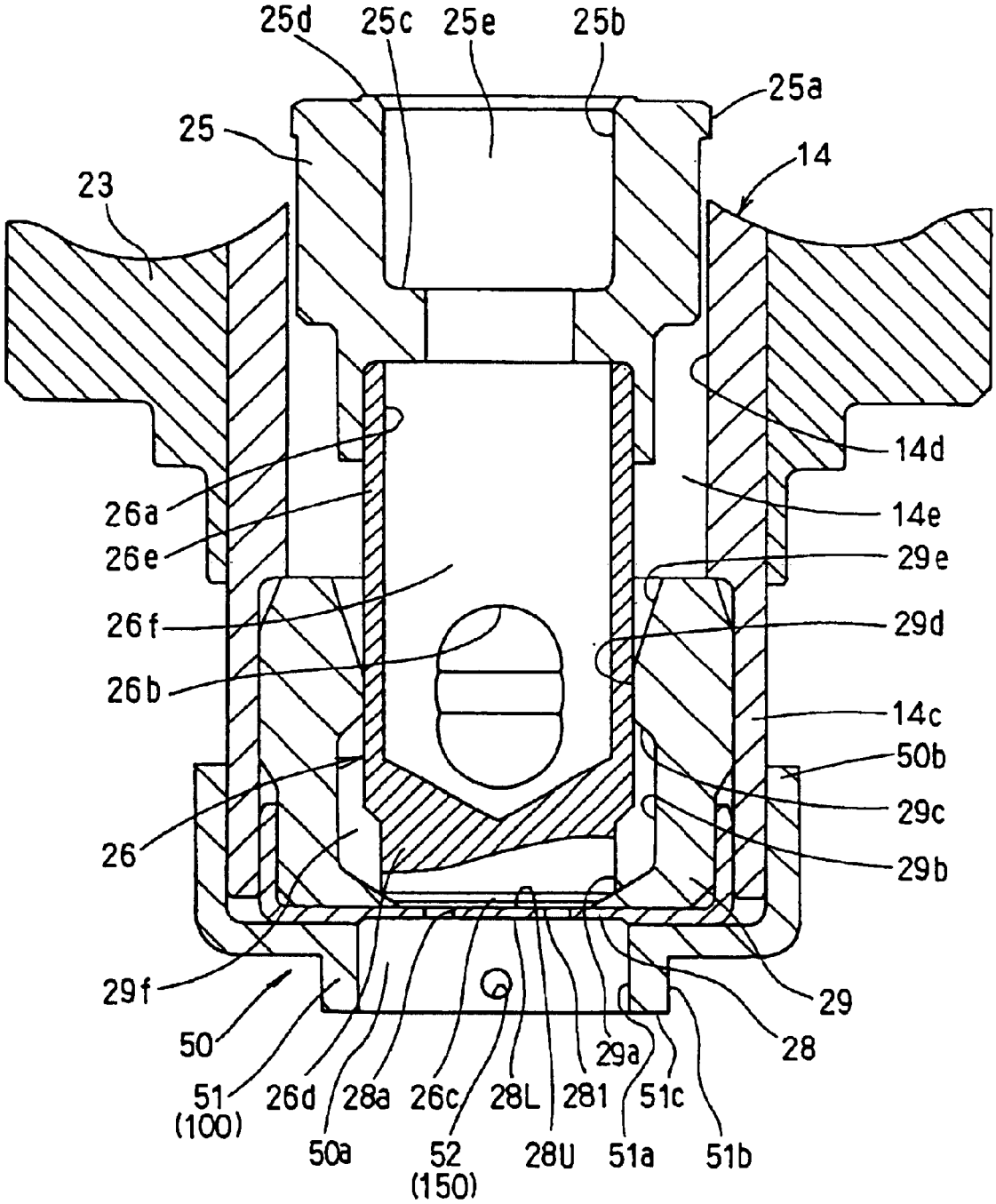
FIG. 2 is a sectional view of a tip portion of the injector of the first embodiment.
Figure 3:
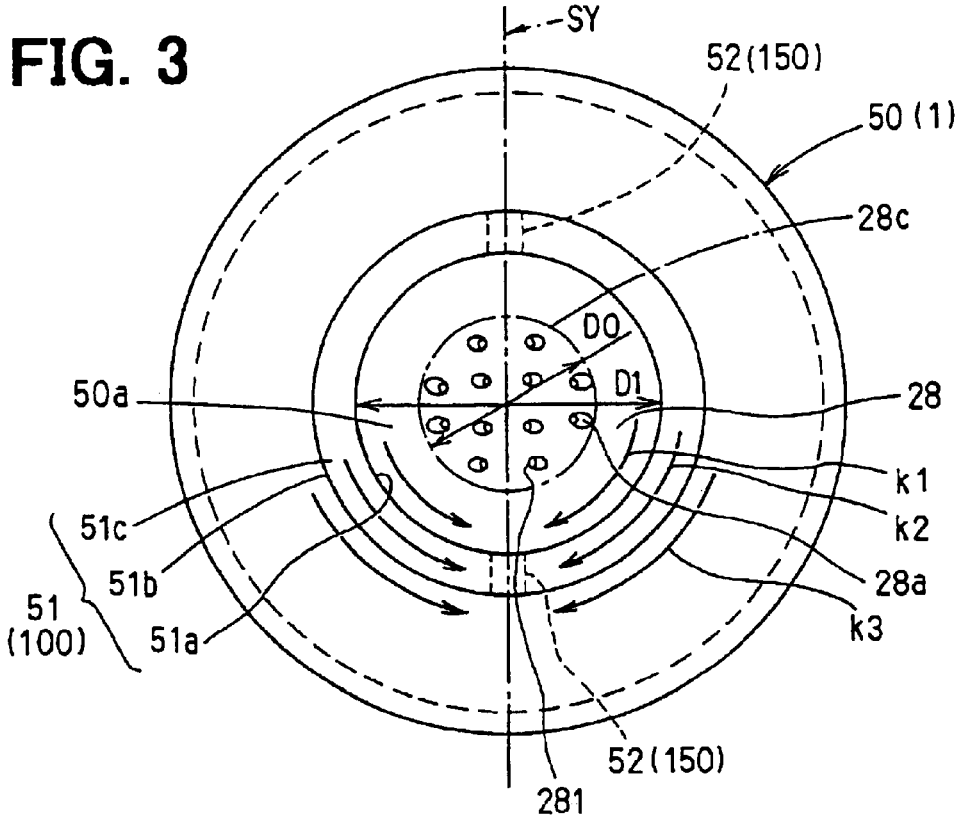
FIG. 3 is a plan view of a tip of the injector of the first embodiment as seen in the direction III in FIG. 1.
Figure 4:
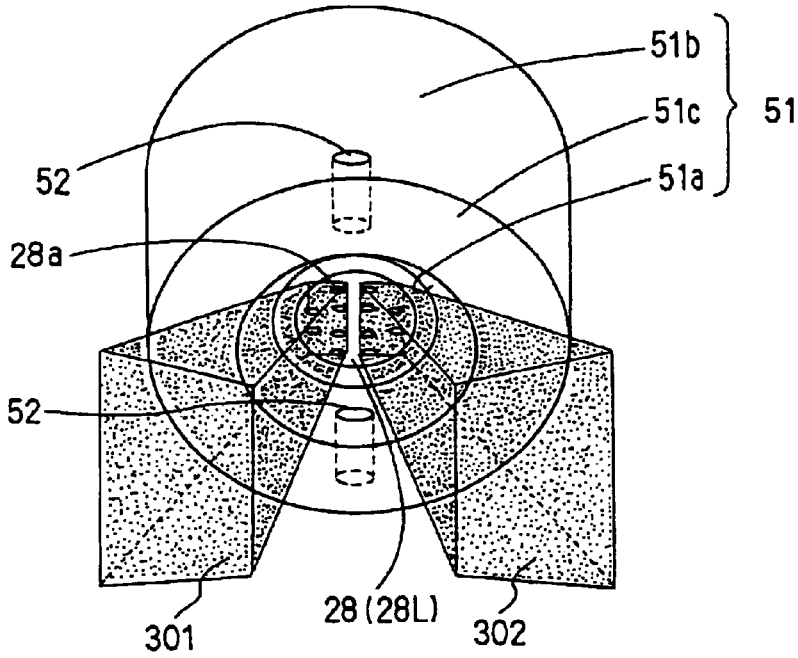
FIG. 4 is a perspective view of the tip of the injector of the first embodiment.
Figure 5:
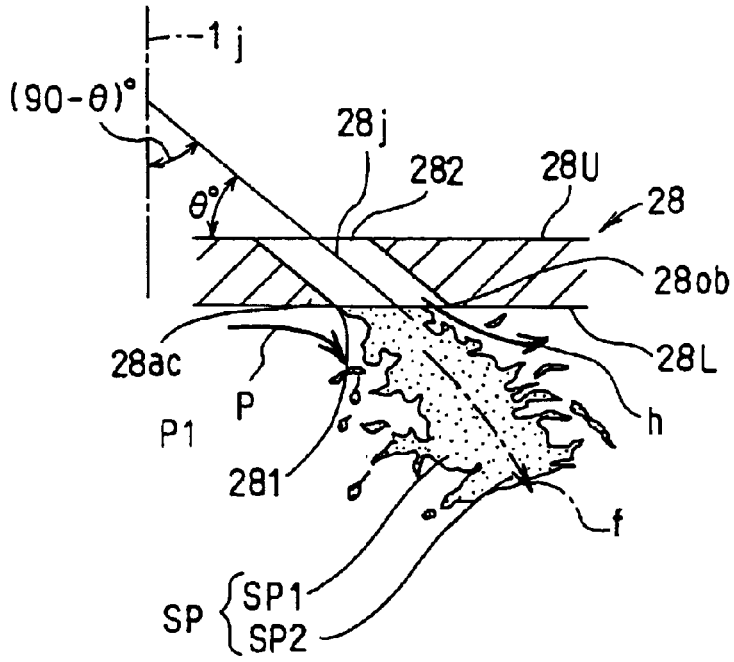
FIG. 5 is an enlarged sectional view of an orifice plate in the injector of the first embodiment.
Figure 6:
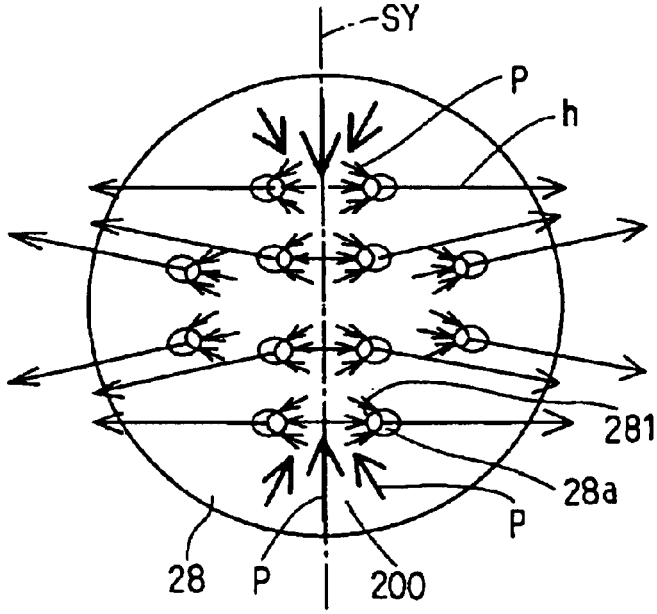
FIG. 6 is a plan view of the orifice plate in the injector of the first embodiment.
Figure 7A:
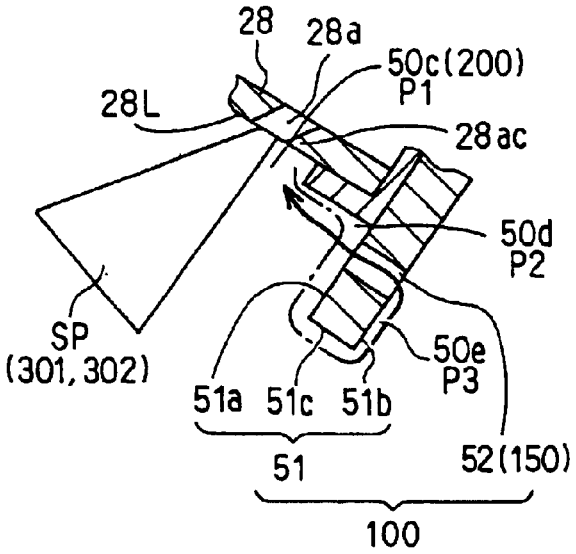
FIG. 7A is a partially enlarged sectional view showing a radial section of the injector of the first embodiment.
Figure 7B:
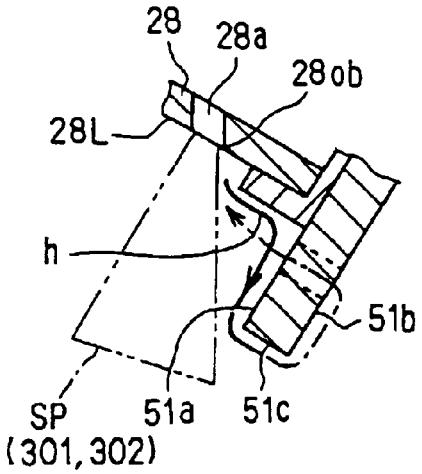
FIG. 7B is a partially enlarged sectional view showing a radial section of the injector of the first embodiment.
Figure 8:
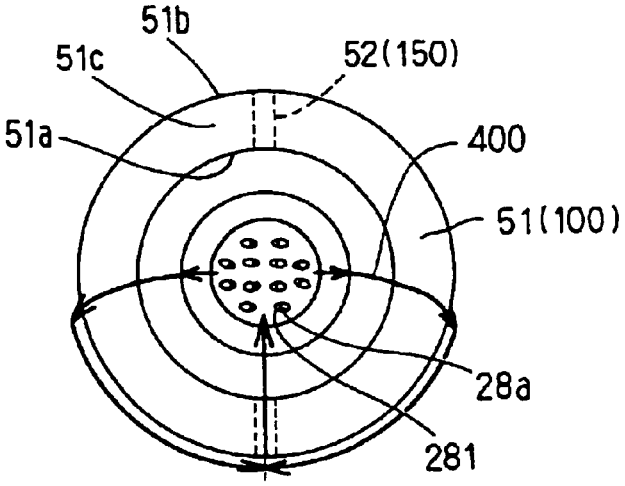
FIG. 8 is a plan view of the tip of the injector of the first embodiment.

FIG. 1 is a sectional view showing a schematic construction of a fuel injector according to a first embodiment of the present invention. FIG. 2 is an enlarged sectional view of a principal portion of FIG. 1. FIG. 3 is a plan view as seen in the direction III in FIG. 1. FIG. 4 is a perspective view showing a fuel spray shape schematically. FIG. 5 is a sectional view showing an orifice plate and a fuel jet. FIG. 6 is a plan view showing a flow of fuel on a surface of the orifice plate. FIGS. 7A and 7B are enlarged sectional views of the injector, showing a path for the recovery of adhered fuel. FIG. 8 is a plan view as seen in the direction III in FIG. 1, showing a flow of adhered fuel.

The injector, indicated at 1, is used in an internal combustion engine (simply "engine" hereinafter), especially a gasoline engine. The injector 1 is attached to an intake pipe of the engine and is supplied with pressurized fuel from a pump (not shown). The fuel injected from the injector is fed together with intake air to a combustion chamber in the engine. The injector 1, which is generally cylindrical, receives fuel from one end and injects it from an opposite end. The injector 1 has a valve section which turns on and off the injection of fuel, an electromagnetic drive section for actuating the valve section, and a spray forming section which atomizes the fuel and forms a spray. A filter 11 is attached to a fuel inlet of the injector 1 to eliminate foreign matters.

The valve section has a valve body 29 and a valve member ("needle" hereinafter) 26. The valve body 29 is fixed to an inner wall of a cylindrical member 14 by welding. The valve body 29 is press-fitted or inserted into a magnetic cylindrical portion 14*c* of the cylindrical member 14. The valve body 29 and the magnetic cylindrical portion 14*c* are welded throughout the whole circumference from the outside. Inside the valve body 29 is formed a conical slant face 29*a* which serves as a valve seat. The needle 26 is adapted to move into abutment against and away from the valve seat. Inside the valve body 29 is formed a fuel passage for the fuel to be injected into the engine, and the conical slant face 29*a*, a large-diameter wall surface 29*b*, a conical slant face 29*c*, a small-diameter wall surface 29*d* which supports the needle 26 slidably, and a conical slant face 29*e*, are formed successively from the downstream side to the upstream side of the fuel flow. The valve seat 29*a* becomes smaller in diameter along the fuel flow. In cooperation with an abutment portion 26*c* of the needle 26 the valve seat 29*a* performs valve opening and closing operations of the valve section. The large-diameter wall surface 29*b* defines a fuel staying hole, i.e., a fuel sump 29*f* which is enclosed together with the needle 26. The small-diameter wall surface 29*d* forms a needle support hole which supports the needle 26 slidably. The needle support hole formed by the small-diameter wall surface 29*d* is smaller in diameter than the fuel sump formed by the large-diameter wall surface 29*b*. The conical slant face 29*e* becomes larger in diameter upstream of fuel flow.

The needle 26 is a bottomed cylinder. The abutment portion 26*c*, which can move into abutment against and away from the valve seat 29*a*, is formed at a tip portion of the needle 26. The needle 26 is provided at the tip portion thereof with a cylindrical small-diameter portion 26*d* formed in a cylindrical shape of a small diameter and is also provided with a cylindrical large-diameter portion 26*e* which is supported slidably by the valve body 29. An outer periphery of the tip of the cylindrical small-diameter portion 26*d* is chamfered to form a conical slant face which constitutes the abutment portion 26*c*. The diameter of the abutment portion 26*c* defines a valve seat diameter. In this embodiment, the seat diameter is smaller than the diameter of the small-diameter wall surface 29*d*. Therefore, a precision machining for the valve seat 29*a* can be done easily and it is possible to enhance the sealability. For example, after forming the small-diameter wall surface 29*d*, conical slant face 29*c*, large-diameter wall surface 29*b* and valve seat 29*a* of the valve body 29 by a cutting work, it is possible to easily perform a finishing work for the improvement of sealability. For example, a precision machining for the valve seat 29*a* can be effected by inserting a cutting tool into the fuel sump 29*f*. An outside diameter of the cylindrical large-diameter portion 26*e* is somewhat smaller than an inside diameter of the small-diameter wall surface 29*d*. In the cylindrical large-diameter portion 26*e*, an inner passage 26*f* for fuel is defined by an inner wall surface 26*a*. The inner passage 26*f* is formed by a piercing work. Its diameter and depth are designed from the standpoint of reducing the weight of the needle 26 and ensuring a required strength. In the cylindrical large-diameter portion 26*e* is formed at least one outlet hole 26*b* so as to provide communication between the inner passage 26*e* and the fuel sump 29*f*.

The spray forming section has an orifice plate 28 formed with plural orifices and also has a cylindrical member 50. The orifice plate 28 is disposed at a tip of the valve body and sprays fuel in an atomized state from the plural orifices. The orifice plate 28 is a thin metallic sheet. The orifice plate 28 is formed with plural orifices 28 in an area opposed to a tip end face of the needle 26. The orifice plate 28 is disposed at the tip of the injector 1. As to the orifices 28*a*, their appropriate size, orifice axis direction and arrangement are determined according to required shape, direction and number of fuel spray. An opening area of the orifices defines a flow rate when the valve is opened. Therefore, the amount of fuel injected from the injector 1 is measured on the basis of an opening area of the orifices and a valve open period. The cylindrical member 50 is attached to the tip of the injector 1 to protect the orifice plate 28. Further, a part of the cylindrical member 50 extends downstream of the orifice plate 28 to assist the formation of a fuel spray.

The electromagnetic drive section has a coil 31, a cylindrical member 14, an armature 25, and a compression spring 24. The injector 1 opens the valve when the electromagnetic drive section is energized and closes the valve when the electromagnetic drive section is deenergized. The coil 31 is wound round an outer periphery of a spool 30 made of resin. End portions of the coil 3 are drawn out as two terminals 12. The spool 30 is fitted on an outer periphery of the cylindrical member 14. A resin mold 13 is disposed on the outer periphery of the cylindrical member 14 and it is provided with a connector portion 16 for receiving the terminals 12 therein. The cylindrical member 14 is a pipe comprising a magnetic portion and a non-magnetic portion. For example, it is formed using a composite magnetic material. The cylindrical member 14 has a magnetic cylindrical portion 14*a*, a non-magnetic cylindrical portion 14*b*, and a magnetic cylindrical portion 14*c* successively from above to below in FIG. 1. The non-magnetic cylindrical portion 14*b* is formed by heating and thereby non-magnetizing a part of the cylindrical member 14. An armature receiving hole 14*e* is formed along an inner periphery of the cylindrical member 14 and the armature 25 is received in a position near the boundary between the non-magnetic cylindrical portion 14*b* and the magnetic cylindrical portion 14*c*. The cylindrical member 14 forms a magnetic circuit in which there flows a magnetic flux induced upon energization of the coil 31. Outside the cylindrical member 14 are provided a magnetic member 23, a resin mold 15, and a magnetic member 18. The magnetic member 23 covers an outer periphery of the coil 13. The magnetic member 18 is a C-shaped plate. The resin mold 15 is formed on outer peripheries of the magnetic members 18 and 23 and is connected to the resin mold 13. The armature 25 is a stepped cylindrical member formed of a ferromagnetic material such as magnetic stainless steel. The armature 25 is fixed to the needle 26. An internal space 25*e* of the armature 25 is in communication with an inner passage 26*f* formed in the needle 26. An attracting member 22 is a cylindrical member formed of a ferromagnetic material such as magnetic stainless steel. A stator member 22 is fixed to an inner periphery of the cylindrical member 14 by press-fitting for example. An adjusting pipe 21 is press-fitted and fixed to an inner periphery of the stator member 22. The compression spring 24 urges the armature 25 toward the valve body 29. It is disposed between an end face of the adjusting pipe 21 and a spring seat 25*c* of the armature 25. A biasing force of the compression spring 24 is adjusted by adjusting the amount of press fit of the adjusting pipe 21. The magnetic circuit is made up of the magnetic cylindrical portion 14*a*, stator member 22, armature 25, magnetic cylindrical portion 14*c*, magnetic member 23, and magnetic member 18.

The operation of the injector 1 will now be described. When the coil 31 is energized, an electromagnetic force is developed in the coil. Consequently, the armature 25 is attracted toward the stator member 22 and the needle valve 26 moves away from the valve seat 29*a*. As a result, the valve in the injector 1 opens and fuel is injected through the orifices 28*a*. When the coil 31 is de-energized, the electromagnetic force developed in the coil 31 vanishes. The needle 26 is pushed toward the valve seat 29*a* by the compression spring 24 and the injector 1 closes to cut off the fuel spray. The amount of fuel injected from the injector 1 is adjusted by adjusting the energization period of the coil 31.

Most of the fuel injected from the injector 1 is fed to a combustion chamber together with intake air. As each combustion. However, a portion of the fuel injected from the injector 1 may adhere to the tip portion of the injector or to the intake pipe. The adhered fuel impairs the accuracy in the amount of fuel fed to the combustion chamber and impairs the accuracy of combustion control in the engine. For example, as the flow velocity of intake air increases, the spread of fuel spray is partially impeded and a portion of the impeded spray may adhere to the tip portion of the injector 1. As the amount of such adhered fuel increases, the amount of fuel fed to the combustion chamber becomes smaller than an ideal fuel quantity. On the other hand, as the amount of adhered fuel decreases, the amount of fuel fed to the combustion chamber becomes larger than the ideal fuel quantity. There sometimes occurs a case where the adhered fuel is sucked into the combustion chamber at an undesirable timing, which may result in the occurrence of incomplete combustion for example. If the engine is stopped in a residual state of adhered fuel, the adhered fuel will evaporate within the intake pipe. With the valve closed, the injector 1 has a dead volume on a downstream side with respect to the tip of the needle 26. Consequently, the fuel staying in the dead volume may leak out under the action of intake negative pressure and become adhered fuel.

In this embodiment, the adhered fuel is diminished or removed under the action of the following principle of solution. More particularly, the fuel adhered to the tip of the injector is diminished. Still more particularly, a drop of adhered fuel is prevented from growing too large. At least either splashes of fuel injected from the orifices 28*a* of the injector 1 or the fuel leaking out from the dead volume is to be diminished.

The injector of this embodiment is provided with a recovery means for the recovery of adhered fuel. The recovery means comprises a member for forming a negative pressure region by the injection of fuel and a member for forming a guide path through which adhered fuel is to be conducted toward the orifices 28*a* by the negative pressure present in the negative pressure region. In this embodiment there is formed a flow of air which guides the adhered fuel toward an outlet of the orifices 28*a*. At the outlet of the orifices 28*a* the adhered fuel joins the fuel jet and is sprayed. As a result, the adhered fuel is fed to the combustion chamber in the engine and is consumed therein. Thus, in this embodiment, although adhered fuel occurs, it is prevented from increasing to excess because it is recovered at a constant speed. Consequently, it is possible to suppress a temporary decrease or increase in the amount of fuel. The flow which conducts the adhered fuel to the outlet of the orifices 28*a* is formed by the fuel jet injected from the orifices 28*a*. In this embodiment, a negative pressure forming section 200 is provided downstream and near the orifice plate 28. Utilizing the negative pressure formed in the negative pressure forming section as a suction force, the recovery means conducts the adhered fuel toward the negative pressure forming section.

As shown in FIG. 2, the tip portion of the injector 1 is made up of the orifice plate 28 and the stepped cylindrical portion 50. The cylindrical portion 50 has an opening portion 50*a* which surrounds the orifices formed in the orifice plate 28 and a mounting portion 50*b* which is mounted to the outer periphery of the cylindrical member 14. The opening portion 50*a* is formed by an annular wall 51 extending from a lower surface 28L of the orifice plate 28 downstream. The annular wall 51 provides an inner periphery surface 51*a*, an outer periphery surface 51*b*, and a downstream-side tip 51*c*. Further, the annular wall 51 provides a wall surface to which adhered fuel can adhere. Thus, it is not necessary for the annular wall 51 to be continuous annularly. For example, the annular wall 51 may be substituted by plural wall surface portions. In the annular wall 51 there are formed guide holes 52 which extend radially through the injector 1, as shown in FIG. 2. The guide holes 52 are provided at positions near a tip of the annular wall 51.

The annular wall 51 and the guide holes 52 constitute a recovery section 100 which serves as the recovery means. The annular groove 51 provides a wall surface which permits adhesion thereto and movement thereon of the adhered fuel. Besides, the annular wall 51 causes a negative pressure to be developed and held stably in a certain region, the negative pressure being generated by the fuel injected from the plural orifices 28*a*. As a result, the adhered fuel flows along the annular wall 51. The guide holes 52 formed in the annular wall 51 act as negative pressure introducing passages 150 for utilizing the negative pressure in the negative pressure forming section 200 effectively. As a result, it is possible to let the influence of the negative pressure generated in the negative pressure forming section 200 reach the outer periphery surface 51*b* through the guide holes 52 and hence possible to suck in the adhered fuel. For attaining such an action, the annular wall 51 is spaced a predetermined distance from the plural orifices 28*a*.

Referring to FIGS. 3, 4, 5, and 6, the construction of the recovery section 100 and that of the negative pressure forming section 200 will now be described. In FIG. 6, the negative pressure forming section 200 is an area in which a negative pressure is generated on the lower surface 28L of the orifice plate 28. The negative pressure is generated across an upper surface of the orifice plate 28 along an axis SY. The negative pressure occurs continuously on the axis XY and reaches the inner periphery surface 51*a*. The negative pressure developed in the negative pressure forming section 200 sucks in fluid in the direction of a thick-line arrow P. The negative pressure is formed by both the flow of fuel injected from the orifices 28*a* arranged on both sides of the axis SY and the flow of air which accompanies the fuel flow. Each orifice 28*a* is inclined relative to the lower surface 28L of the orifice plate. The angle of inclination of each orifice 28*a* is represented in terms of a deviation angle θ of an axis ("orifice axis" hereinafter) 28*j* of the orifice from the surface of the orifice plate 28 or an expanse angle (90−θ) from a central axis 1*j* of the injector 1. A negative pressure is generated non-uniformly around the orifices, which is attributable to the deviation angle of the axis 28*j*. The negative pressure is strong radially inside the orifice plate 28 and is weak radially outside the orifice plate. The plural orifices 28*a* are divided into two groups. Plural orifices belonging to one group and those belonging to the other group are inclined so as to expand downstream of the injector axis 1*j*. A fuel jet SP spouts from an outlet 281 of each orifice 28*a* in a dot-dash line arrow direction "f" along the orifice axis 1*j*. Just under an acute portion 28*ac* of the orifice plate 28 there occurs a negative pressure P1 near the downstream side of the lower surface 28L because the fuel jet SP as a high-speed jet released into air and the lower surface 28L are in an acute relation. Therefore, a flow indicated by a thick-line arrow direction "P" is formed along the lower surface 28L by a jet SP1 flowing on the acute portion 28*ac* side. This flow "P" carries the adhered fuel to the outlet 281 of the orifice 28*a*. Conversely, just under an acute portion 28*ob* of the orifice plate 28, it becomes easier for splashes of the fuel jet SP to adhere to the orifice plate 28 because the high-speed jet SP and the lower surface 28L are in an acute relation. The splashes flow in a direction of arrow "h." Further, as shown in FIG. 6, the adhered fuel is carried away radially outwards of the orifice plate 28. In view of such a pressure-flow relation the acute portion 28*ac* is designated a suction side of adhered fuel and the acute portion 28*ob* is designated a supply side of adhered fuel.

The plural orifices 28*a* are arranged in regular order. The plural orifice axes 28*j* are arranged to be axisymmetric with respect to the axis SY. With such an arrangement of the orifices 28*a*, the injector 1 can atomize the fuel through plural orifices and provide a two-way spray, further, it can generate a negative pressure efficiently. In this embodiment, the negative pressure P1 generated in the negative pressure forming section 200 proved to reach −4 kPa (−30 mHg) or so. The plural orifices 28*a* are arranged not only in four parallel rows along the axis SY but also in a double ring shape. BY thus arranging the orifices in plural rows or in plural rings the negative pressure forming section 200 is formed so as to cross the orifice plate 28 and reach the inner periphery surface 51*a*.

The recovery section 100 used in this embodiment has the annular wall 51 and the guide holes 52. The annular wall 51 serves as means for catching and guiding the adhered fuel. The guide holes 52 are provided as negative pressure introducing passages 150 which conducts the adhered fuel again toward the orifices 28*a* by utilizing the negative pressure generated in the negative pressure forming section 200. As shown in FIG. 3, the annular wall 51 is disposed outside and near a circumscribed circle 28*c* of the plural orifices 28*a* formed in the orifice plate 28. As shown in FIG. 3, the annular wall 51 is provided with, as wall surfaces, the inner periphery surface 51*a*, outer periphery surface 51*b*, and downstream-side tip 51*c*. The annular wall 51 is disposed so as not to interfere with fuel jets 301 and 302 which are injected from the plural orifices 28*a*. A diameter D1 of the inner periphery surface 51*a* is set larger than a diameter D0 of the circumscribed circle 28*c* to avoid interference with the jets 301 and 302. Fluid flows occur along the circumference of the annular wall 51. Particularly, fluid flows indicated with arrows "k1" and "k2" occur along the inner periphery surface 51*a* and the tip 51*c*. The guide holes 52 are positioned substantially on an extension of the axis SY. With this arrangement and by virtue of a negative pressure, fluid flows indicated with arrow "k3" can be formed along the outer periphery surface 51*b* of the annular wall 51. Since the guide holes 52 are disposed on the axis SY which undergoes the negative pressure strongly, adhered fuel on the outer periphery surface 51*b* can be guided forcibly to the flow which advances toward the outlets 281 of the orifices 28*a*. Since the annular wall 51 is disposed partially in contact with the negative pressure forming section 200, the adhered fuel can be transported by the negative pressure. Besides, the transport capacity of the annular wall 51 for the adhered fuel can be improved by the guide holes 52.

FIGS. 7A and 7B show sections of the orifice plate 28 and the annular wall 51 in the radial direction. FIG. 7A shows a flow advancing through the guide holes, 52, while FIG. 7B shows a section at a position free of the guide holes 52, in which the flow of adhered fuel is indicated with arrow "h." In FIGS. 7A and 7B, solid lines indicate flows of adhered fuel in the illustrated sections, while dot-dash lines indicate flows of adhered fuel in other sections. In FIG. 7A it is assumed that the pressure of a space 50*c* present near the orifices 28*a* is P1, the pressure of a space 50*d* present inside and near the annular wall 51 is P2, and the pressure present outside and near the annular wall 51 is P3. Just after the start of fuel injection, the pressure P2 does not drop to a satisfactory extent in comparison with the pressure P1 and there is established a relation of P1<P2=P3. As the fuel injection is continued, the pressures P1 and P2 become negative and there is established a relation of P1<P2<P3. Besides, the inside pressures P1 and P2 are drawn out by the guide holes 52 and a negative pressure close to the pressure P1 is developed on the outer periphery surface 51*b* around the guide holes 52. In the construction of this embodiment, the negative pressure reaches −4 kPa (−30 mHg). Adhered fuel flows from the inner periphery surface 51*a* and reaches the outer periphery surface 51*b* through the tip 51*c*, is returned again to the inside of the annular wall 51 through the guide holes 52, further flows along the axis SY of the orifice plate 28, and reaches the outlets of the orifices 28*a*, then is returned to the fuel jet injected from the orifices 28*a*. The flow velocity of adhered fuel at the tip of the injector 1 was found to reach a value in the range of 0.5 to 2 m/s along arrows 400 in FIG. 8.

The injector 1, when mounted to an intake pipe of the engine, is disposed so that the axis 1*j* thereof is inclined with respect to the direction of gravity and so that the direction of spray is coincident with an intake port of the engine. For example, when the injector 1 is mounted on an upper side of the intake pipe, the guide holes 52 are disposed on a lower side in the direction of gravity. In this arrangement, the adhered fuel flows also gravitationally toward the guide holes 52 located on the lower side. Then, by virtue of a negative pressure, the adhered fuel is sucked inside the annular wall 51 and is involved in the spray injected from the orifices 28*a*. In the case where the guide holes 52 are not positioned on the lower side in the direction of gravity, the adhered fuel flows toward the guide holes mainly together with the flow which is formed by the negative pressure. The adhered fuel is then sucked inside the annular wall 51 by the negative pressure and is involved in the spray injected from the orifices 28*a*. Thus, the injector 1 of this embodiment can be utilized in various states of mounting and exhibits an adhered fuel diminishing effect.

In the embodiment described above, the injector 1 has the orifice plate 28 formed with plural orifices 28*a* for the injection of fuel. The injector 1 is further provided with the wall member 51 which extends axially from a radially outside position with respect to the orifice plate. With the injector 1 mounted to the engine, it is desirable that the wall member 51 be disposed at least in a lower region in the gravitational direction. The wall member 51 catches and collects the adhered fuel. Further, the wall member 51 prevents the adhered fuel from falling as a drop. A predetermined negative pressure is formed on the lower surface 28L of the orifice plate 28. The wall member 51 forms a path through which the adhered fuel is returned onto the lower surface 28L of the orifice plate 28 by virtue of a negative pressure. The path is formed by the surface of the wall member 51. The path is also formed by the guide holes 52 which serve as guide passages provided in the wall member 51. The guide passages form paths extending from the lower surface in the gravitational direction of the wall member 51 onto the lower surface 28L of the orifice plate 28. The adhered fuel flows from the wall member 51 onto the lower surface 28L, then again joins the fuel flow injected from the orifices 28*a* and is injected.

On the lower surface 28L of the orifice plate 28 there is defined an area in which a predetermined negative pressure is formed by the flow of fuel injected from the orifices 28*a*. This area may be defined by both plural orifices 28*a* and wall member 51. In this embodiment, the plural orifices 28*a* and the wall member 51 are disposed such that a predetermined negative pressure is generated in the area. It is desirable that the area extend toward the inner wall surface 51*a* of the wall member 51. A flow of air advancing toward the area is formed at the tip portion of the injector by virtue of the negative pressure present in the same area.

The wall member 51 forms a path for returning the adhered fuel again onto the lower surface 28L of the orifice plate 28. The path is formed along the flow of air entering the area. A part of the area extends up to a specific edge portion located on a radially outside position on the lower surface 28L of the orifice plate 28. The wall member 51 is disposed in proximity to the specific edge portion. The adhered fuel flows through the path on the wall member 51, then flows from the specific edge portion onto the lower surface 28L, again joins the flow of fuel injected from the orifices 28*a* and is injected. To promote the flow of adhered fuel to the lower surface 28L of the orifice plate 28, negative pressure introducing passages 150 are formed in positions close to the orifice plate 28.

The orifices 28*a* and the wall member 51 constitute a negative pressure region forming means for forming a negative pressure region on the lower surface of the orifice plate 28 of the injector 1, the negative pressure region reaching a radially outer edge portion of the orifice plate 28. The wall member 51 constitutes a path forming means for forming a path through which the fuel adhered to the tip of the injector 1 flows toward the negative pressure region. The negative pressure introducing passages 150 also constitute a path forming means for forming a path through which the adhered fuel on the wall member 51 flows toward the negative pressure forming region. Further, the negative pressure introducing passages 150 disposed on the lower side in the gravitational direction in an actually working condition of the injector 1 serve as means for forming a path which extends from the adhered fuel collecting position to the negative pressure region.

Second Embodiment

A description will be given below about a second embodiment of the present invention, in which the same or equivalent constructional points will be identified by like reference numerals and repeated explanations thereof will be omitted.

Figure 9:
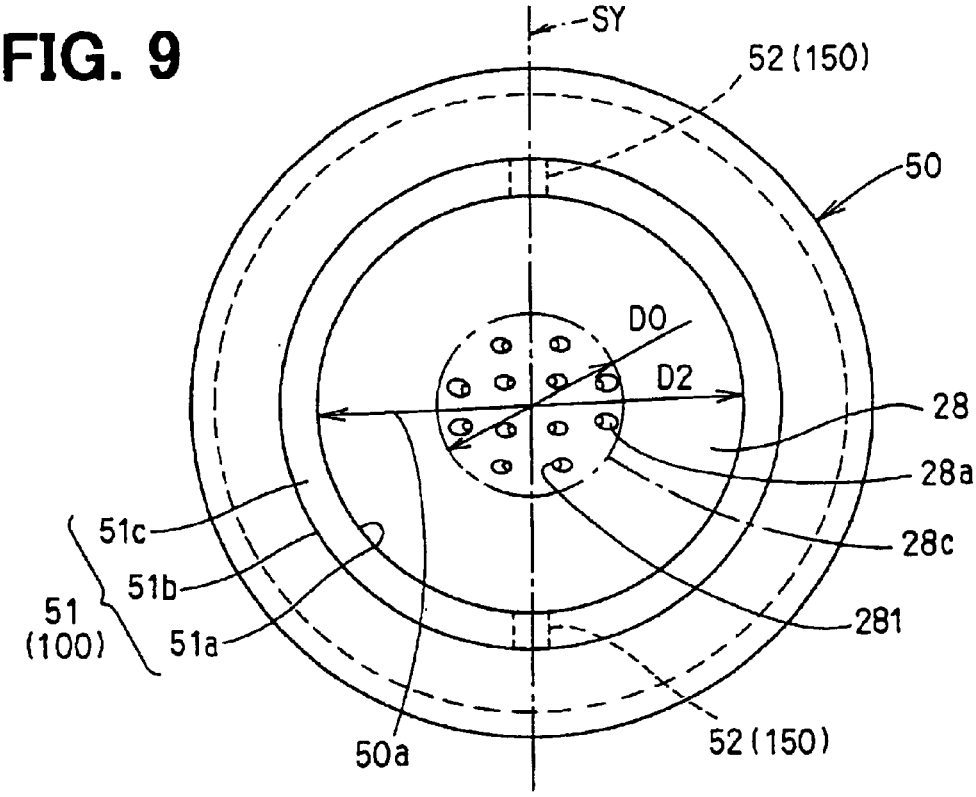
FIG. 9 is a plan view of a tip of an injector according to a second embodiment of the present invention.

In this second embodiment, as shown in FIG. 9, an opening diameter D2 of an inner periphery surface 51*a* of an annular wall 51 is set larger than the opening diameter D1 in the first embodiment. FIG. 9 is a plan view illustrating a tip of an injector according to a modification 1. With this construction, the amount of adhered fuel can be decreased because it is possible to enlarge the distance between the fuel spray and the annular wall 51. Besides, adhered fuel can be recovered in the same manner as in the first embodiment.

Third Embodiment

Figure 10:
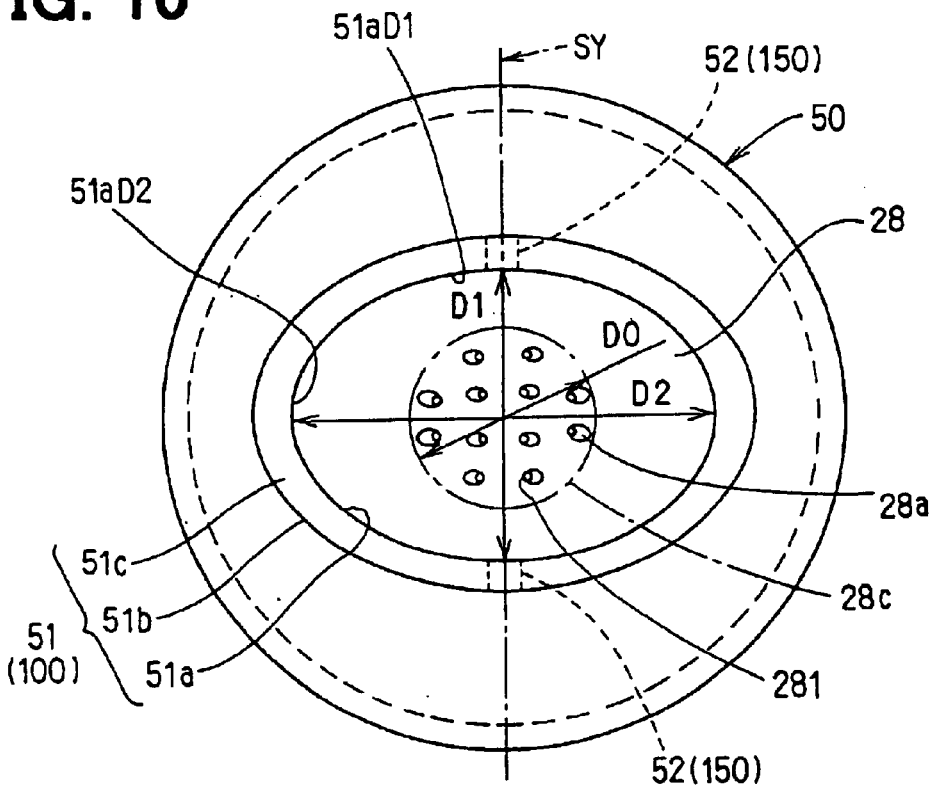
FIG. 10 is a plan view of a tip of an injector according to a third embodiment of the present invention.

In this embodiment, the shape of an opening portion 50*a* is elliptic as in FIG. 10 instead of the circular shape described above in the first embodiment. As to an inner periphery surface 51*a* of the annular wall 51, a minor diameter D1 is disposed in a transverse direction of a negative pressure forming section 200. In other words, a minor diameter D1 of the ellipse is disposed on the axis SY. Therefore, a major diameter D2 of the ellipse is aligned with a spreading direction of a two-way spray formed by plural orifices 28*a*. The major diameter D2 is the same as in the second embodiment. As a result, a portion 51*a*D1 of the inner periphery surface 51*a*, which portion is positioned near the minor diameter D1 of the ellipse, can be disposed near the negative pressure forming section 200. Consequently, a negative pressure can be exerted strongly on guide holes 52. On the other hand, a portion 51*a*D2 of the inner periphery surface 51*a*, which portion is positioned near the major axis D2 of the ellipse, is spaced away from the orifices 28*a*. Accordingly, the adhesion of fuel jet splashes is diminished. Besides, the elliptic inner periphery surface 51*a* provides a continuous surface toward the portion 51*a*D1, thus permitting the provision of a continuous path for allowing the adhered fuel to flow toward the portion 51*a*D1. With this elliptic inner periphery surface 51*a*, it is possible to diminish and remove the adhered fuel even in the case of such orifice specifications, e.g., layout and number, as can make the pressure P1 into only a relatively weak negative pressure.

Fourth Embodiment

Figure 11:
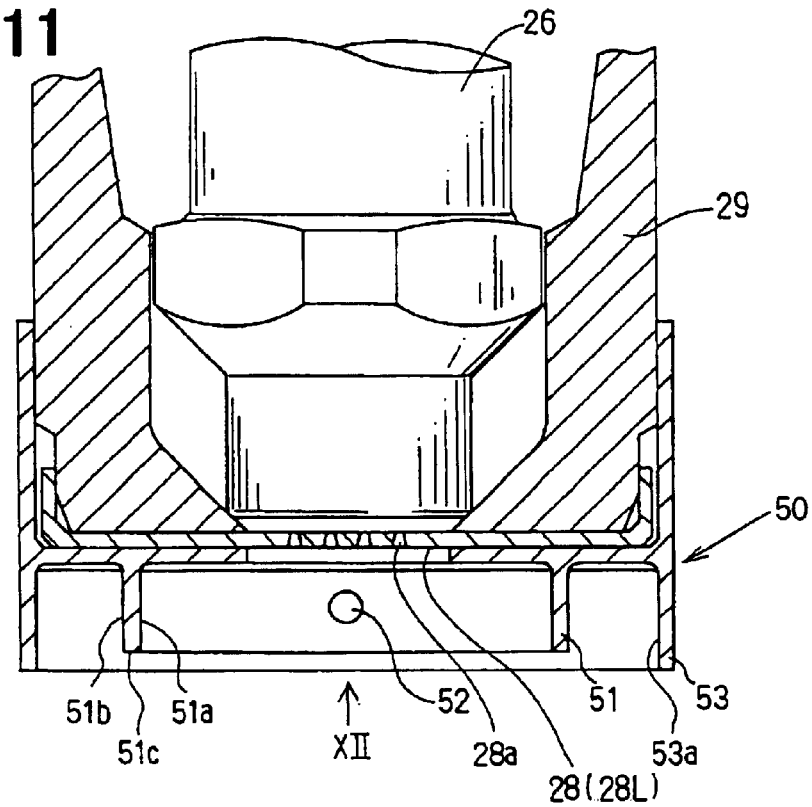
FIG. 11 is a sectional view of a tip portion of an injector according to a fourth embodiment of the present invention.
Figure 12:
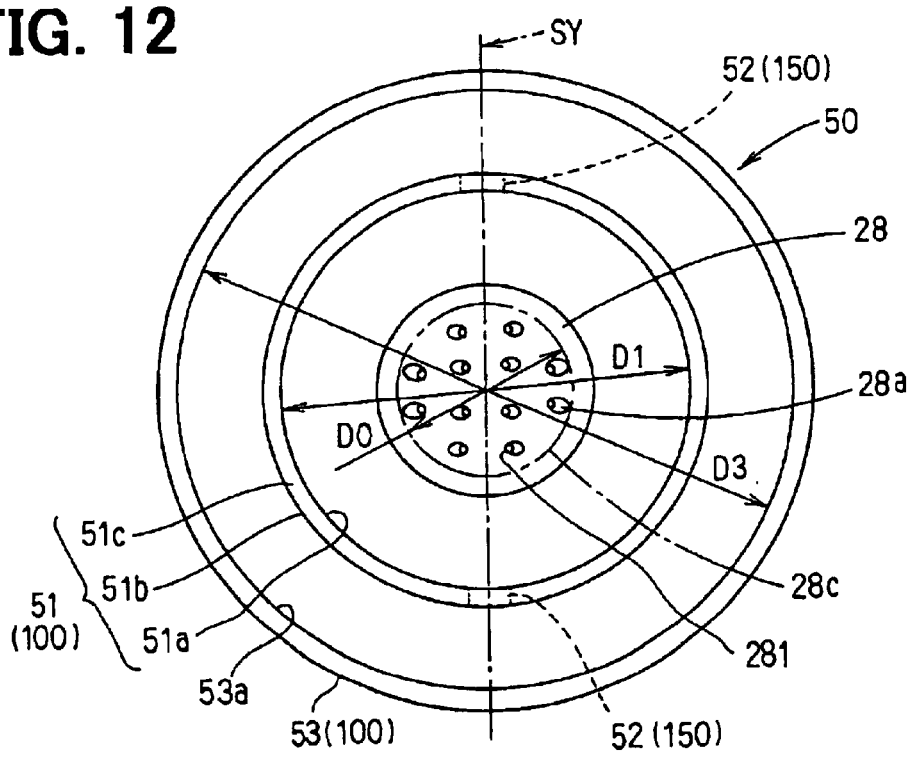
FIG. 12 is a plan view of a tip of the injector of the fourth embodiment.
Figure 13:
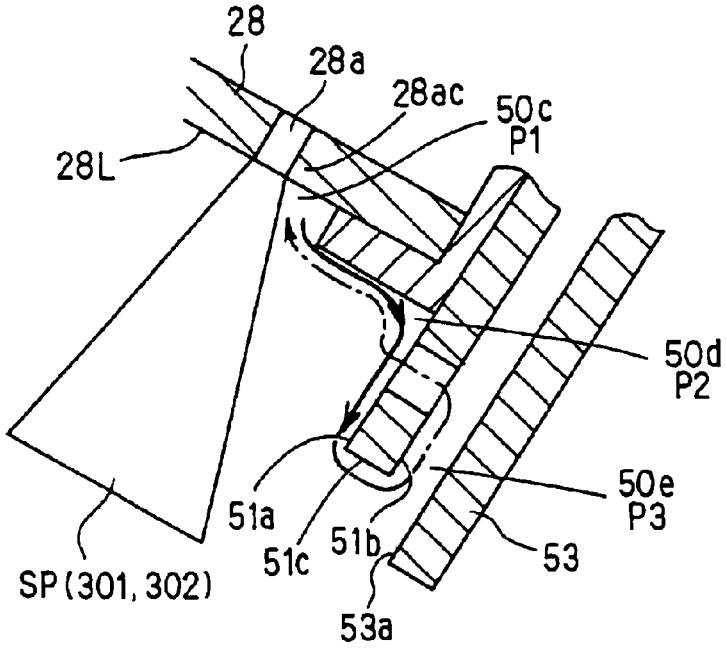
FIG. 13 is a partially enlarged sectional view showing a radial section of the injection of the fourth embodiment.
Figure 14A:
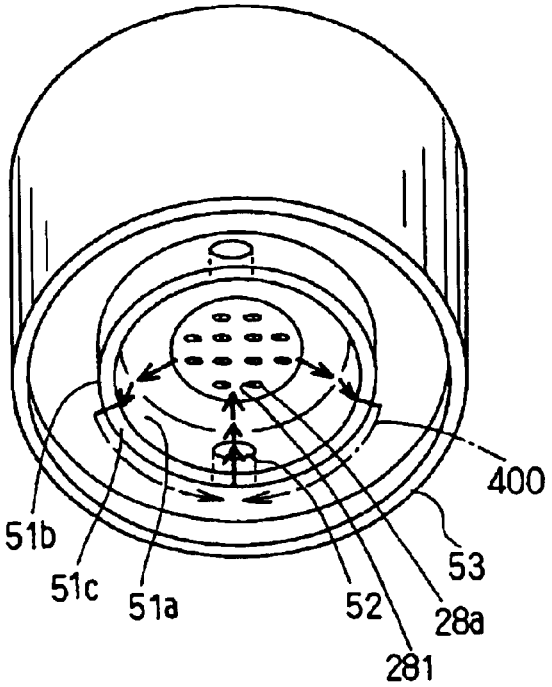
FIG. 14A is a perspective view of the tip of the injector of the fourth embodiment.
Figure 14B:
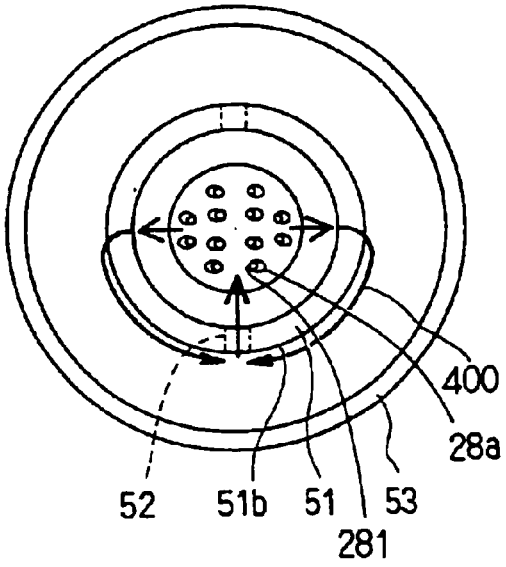
FIG. 14B is a plan view of the tip of the injector of the fourth embodiment.

An injector according to a fourth embodiment of the present invention will now be described with reference to FIGS. 11 to 14B. FIG. 11 is a sectional view of a principal portion of the injector. FIG. 12 is a plan view of FIG. 11 as seen in XII direction. FIG. 13 is a radial, partial sectional view showing a principal portion of the injector. FIG. 14A is a perspective view of a tip portion of the injector. FIG. 14B is a plan view of the injector tip portion. In this embodiment, a needle 26 is solid and a fuel passage is formed outside the needle 26.

The injector 1 of this embodiment has a double annular wall. More specifically, the injector 1 is further provided with an outer annular wall 53 radially outside the annular wall 51 described in the second embodiment. An opening diameter D3 of the outer annular wall is larger than the opening diameter D1 of the inner annular wall 51. The inner and outer annular walls 51, 53 are spaced away from each other, with a gap being formed between the two. Therefore, an intermediate pressure higher than the pressure P1 developed inside the annular wall 51 is formed between the inner and outer annular walls 51, 53. By setting the gap between the two annular walls at a relatively small value, the pressure P3 in the gap can surely be made into a negative pressure. As a result, a pressure relation illustrated in FIG. 13 can be made into P1<P2<P3<atmospheric pressure. With this difference in pressure, adhered fuel can be sucked into the gap and it is possible to increase the moving speed of the adhered fuel. As shown in FIGS. 14A and 14B, the adhered fuel flows like arrows 400.

Fifth Embodiment

Figure 15:
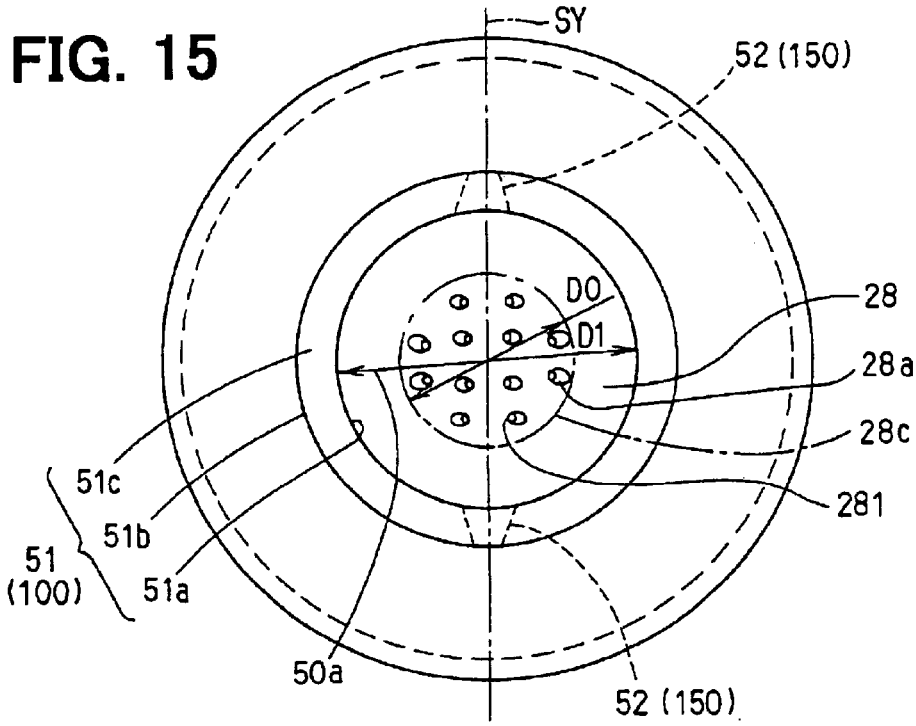
FIG. 15 is a plan view of a tip of an injector according to a fifth embodiment of the present invention.

FIG. 15 is a plan view showing a tip of an injector according to a fifth embodiment of the present invention.

Figure 16A:
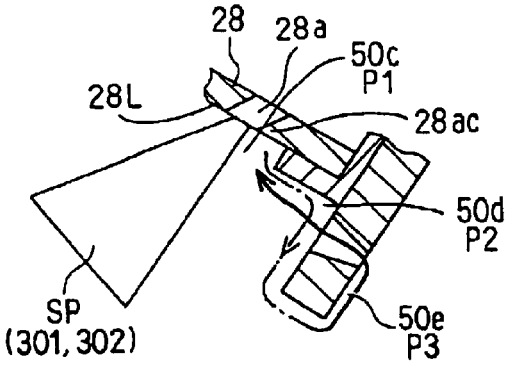
FIG. 16A is a partially enlarged sectional view showing a radial section of the injector of the fifth embodiment.
Figure 16B:
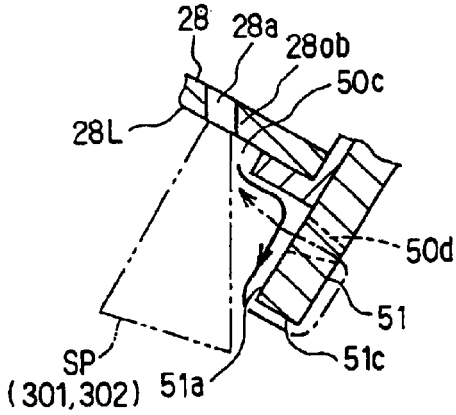
FIG. 16B is a partially enlarged sectional view showing a radial section of the injector of the fifth embodiment.
Figure 17:
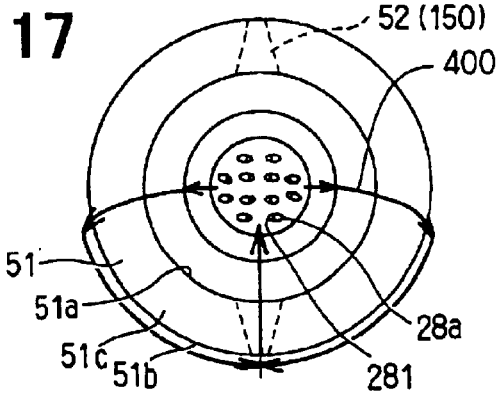
FIG. 17 is a plan view of the tip of the injector of the fifth embodiment.

FIGS. 16A and 16B are enlarged views showing radial sections of the injector, and FIG. 17 is a partial plan view of the injector tip.

Guide holes 52 used in this embodiment are formed in a funnel shape which becomes smaller in diameter radially outwards, instead of holes which are uniform in diameter.

To be more specific, in each guide hole 52, an opening area on an outer periphery surface 51*b* side is set small, while an opening area on an inner periphery surface 51*a* side is set large, whereby the flow velocity of adhered fuel flowing into the opening on the outer periphery surface 51*b* side can be increased. As a result, a kinetic energy of the adhered fuel can be increased and hence it is possible to improve the adhered fuel transport capacity. Besides, the manufacturing cost can be reduced in comparison with forming the outer annular wall 53 as in the fourth embodiment. The funnel-like guide holes 52 are also applicable to other embodiments disclosed herein, including the previous fourth embodiment.

Sixth Embodiment

Figure 18:
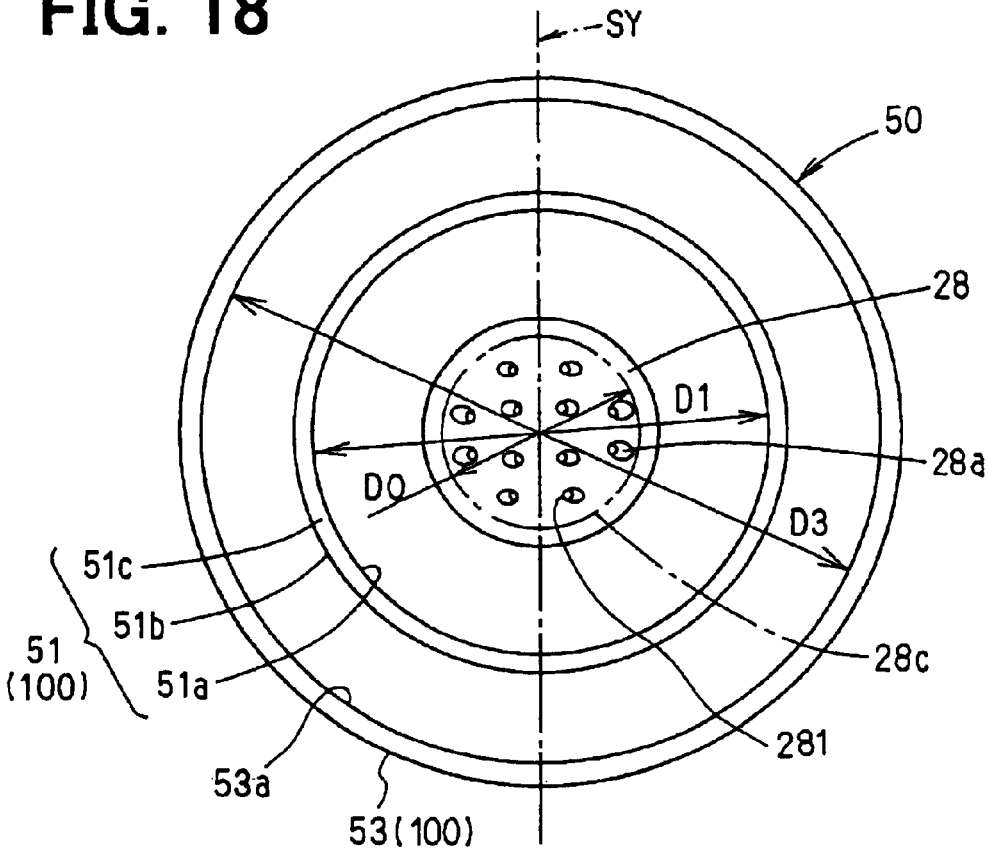
FIG. 18 is a plan view of a tip of an injector according to a sixth embodiment of the present invention.
Figure 19:
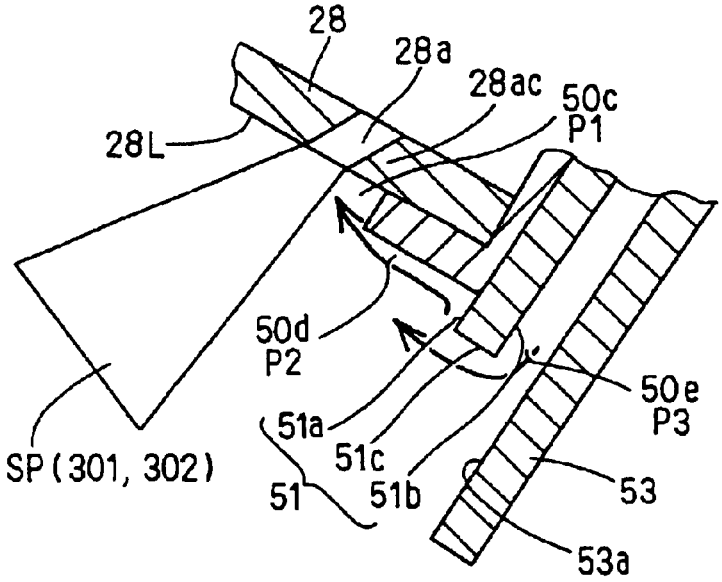
FIG. 19 is a partially enlarged sectional view showing a radial section of the injector of the sixth embodiment.
Figure 20A:
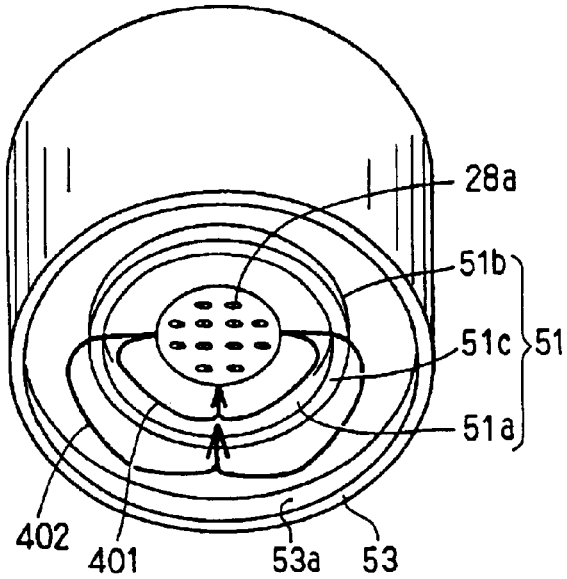
FIG. 20A is a perspective view of the tip of the injector of the sixth embodiment.
Figure 20B:
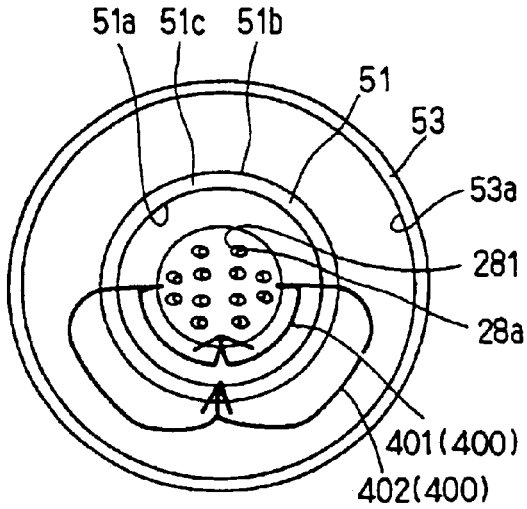
FIG. 20B is a plan view of the tip of the injector of the sixth embodiment.

FIG. 18 is a plan view showing a tip of an injector according to a sixth embodiment of the present invention. FIG. 19 is an enlarged view showing a radial section of the injector. FIG. 20A is a perspective view of the injector tip and FIG. 20B is a plan view thereof.

The injector of this embodiment is provided with a double annular wall similar to that used in the embodiment illustrated in FIG. 12 and is not provided with guide holes 52. The height of an inner annular wall is much smaller than that of an outer annular wall 53. According to this construction, adhered fuel on the inner annular wall 51 flows in the direction of arrow 401 and is recovered. On the other hand, adhered fuel on the outer annular wall 53 flows in the direction of arrow 402 and is recovered. The adhered fuel on the outer annular wall 53 flows radially inwards beyond a tip of the inner annular wall 51. Fuel deviated from a main flow of a spray formed by plural orifices 28*a* is caught by both inner annular wall 51 and outer annular wall 53. Consequently, the frequency of catching the fuel deviated from the main flow can be enhanced. Besides, it is possible to improve the adhered fuel transport capacity.

Seventh Embodiment

Figure 21:
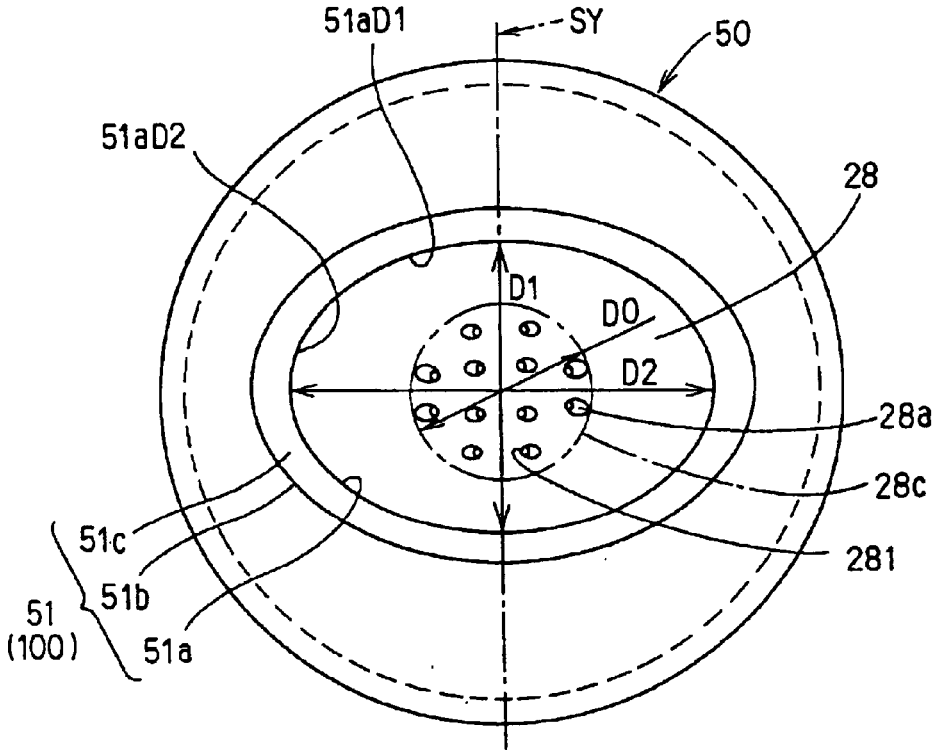
FIG. 21 is a plan view of a tip of an injector according to a seventh embodiment of the present invention.
Figure 22:
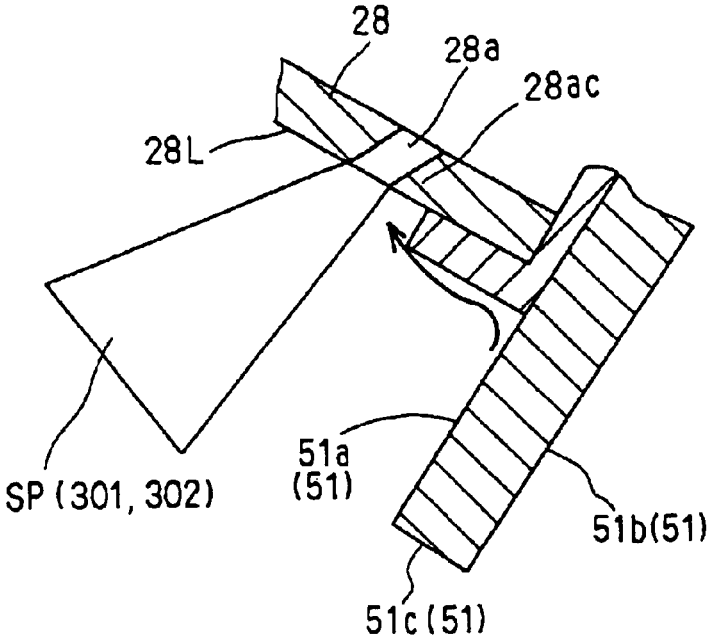
FIG. 22 is a partially enlarged sectional view showing a radial section of the injector of the seventh embodiment.
Figure 23A:
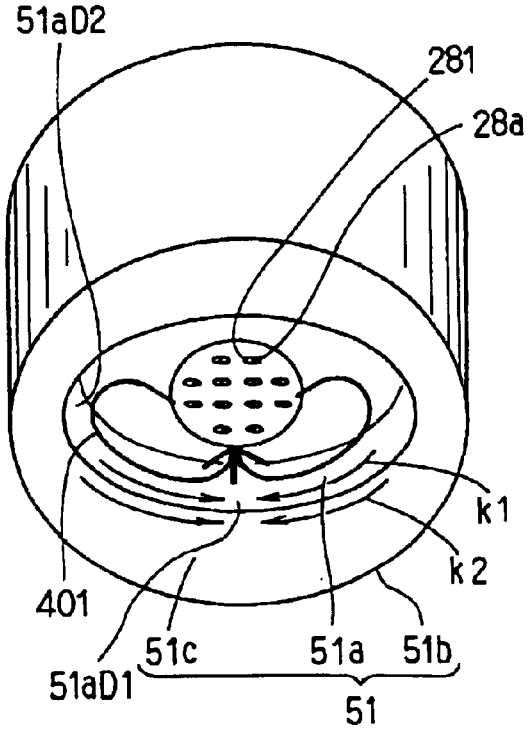
FIG. 23A is a perspective view of the tip of the injector of the seventh embodiment.
Figure 23B:
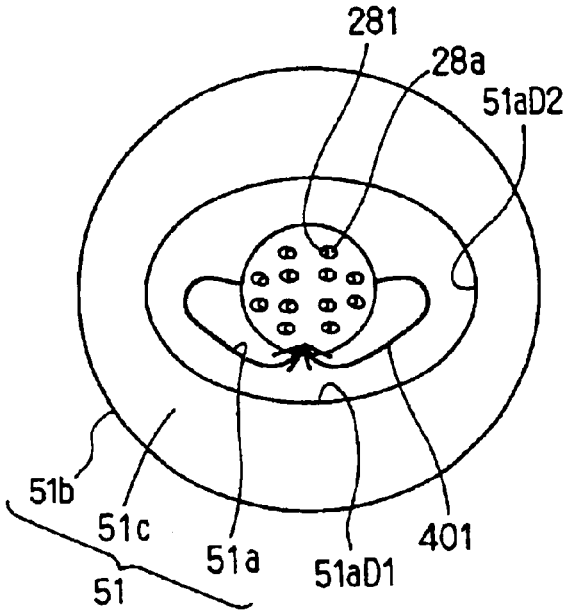
FIG. 23B is a plan view of the tip of the injector of the seventh embodiment.

FIG. 21 is a plan view showing a tip of an injector according to a seventh embodiment of the present invention. FIG. 22 is a partially enlarged sectional view showing a radial section of the injector tip. FIG. 23A is a perspective view of the injector tip and FIG. 23B is a plan view thereof.

The injector of this embodiment has the same elliptic annular wall 51 as that used in the embodiment illustrated in FIG. 10. But the annular wall 51 is not provided with guide holes 52. In this embodiment, adhered fuel flows along only the surface of the annular wall 51. The adhered fuel flows along arrows "k1" and "k2" beyond the annular wall 51 and is recovered along arrow 401. Also in this embodiment it is possible to diminish and remove the adhered fuel.

Eighth Embodiment

Figure 24:
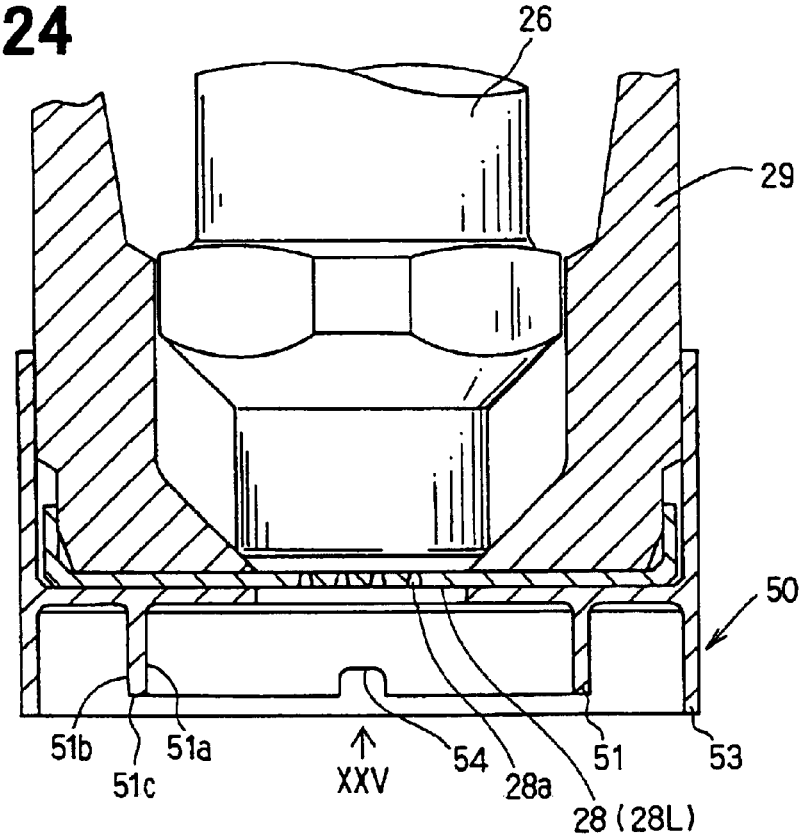
FIG. 24 is a sectional view of a tip portion of an injector according to an eighth embodiment of the present invention.
Figure 25:
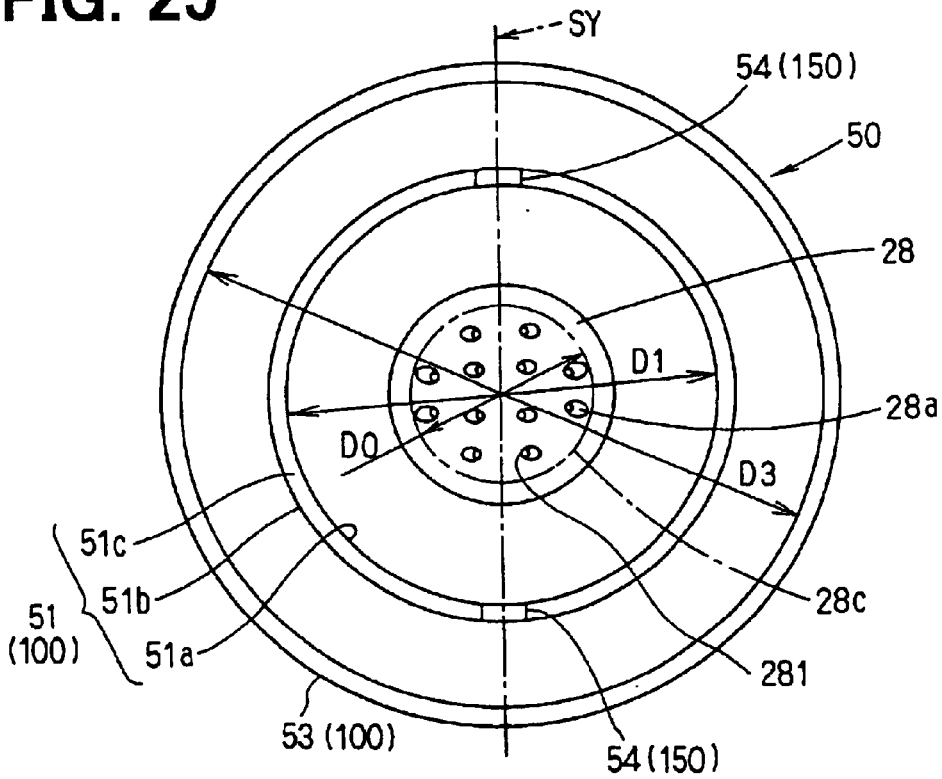
FIG. 25 is a plan view of a tip of the injector of the eighth embodiment.
Figure 26A:
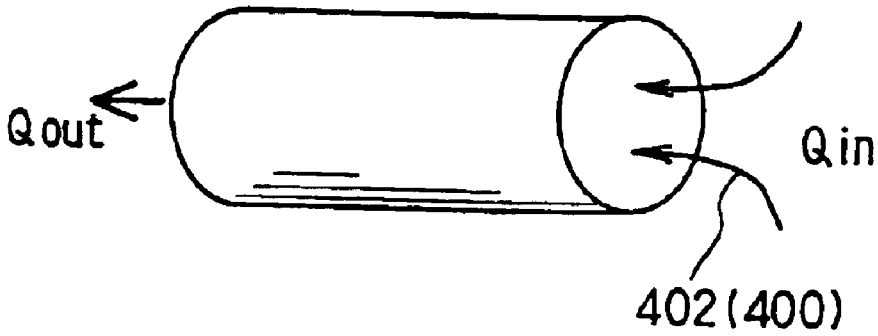
FIG. 26A is a perspective view of a guide hole formed in the injector of the first embodiment.
Figure 26B:
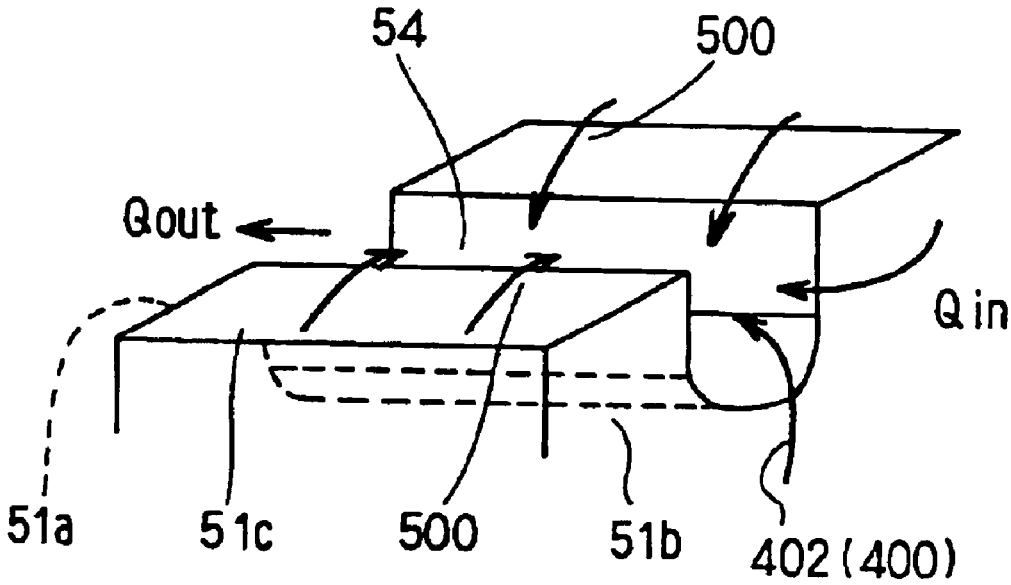
FIG. 26B is a perspective view of a slot formed in the injector of the eighth embodiment.

FIG. 24 is a sectional view showing a tip portion of an injector according to an eighth embodiment of the present invention. FIG. 25 is a plan view of FIG. 24 as seen in XXV direction. FIG. 26A is a perspective view showing a flow in a guide hole. FIG. 26B is a perspective view showing a flow in a slot. In this embodiment, a slot 54 is formed in place of the guide holes 52 used in the embodiment illustrated in FIG. 11. The slot 54 is formed in a tip 51*c* of an inner annular wall 51. A circumferential width and a vertical depth of the slot 54 are set so as to permit easy flow of adhered fuel. An opening area of the slot 54 is set so as not to impair the formation of a negative pressure in a negative pressure forming section 200. In the guide hole 52, as shown in FIG. 26A, an outlet flow rate Qout of a flow 402 of adhered fuel is equal to an inlet flow rate Qin of the flow. As to the slot 54, as shown in FIG. 26B, adhered fuel flows into the slot 54 along arrows 500 also from side portions of the slot. Consequently, the outlet flow rate Qout becomes larger than the inlet flow rate Qin. Since the adhered fuel flows into the slot 54 from the tip 51*c* of the inner annular wall 51, it is not required to reach an outer periphery surface 51*b*.

Ninth Embodiment

Figure 27:
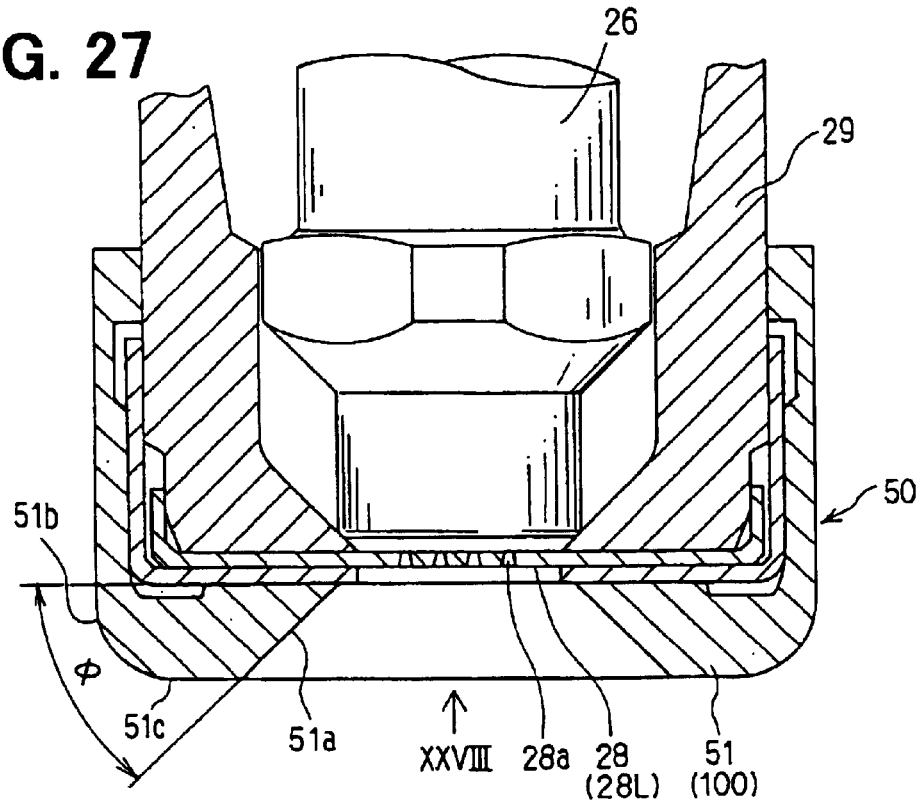
FIG. 27 is a sectional view of a tip portion of an injector according to a ninth embodiment of the present invention.
Figure 28:
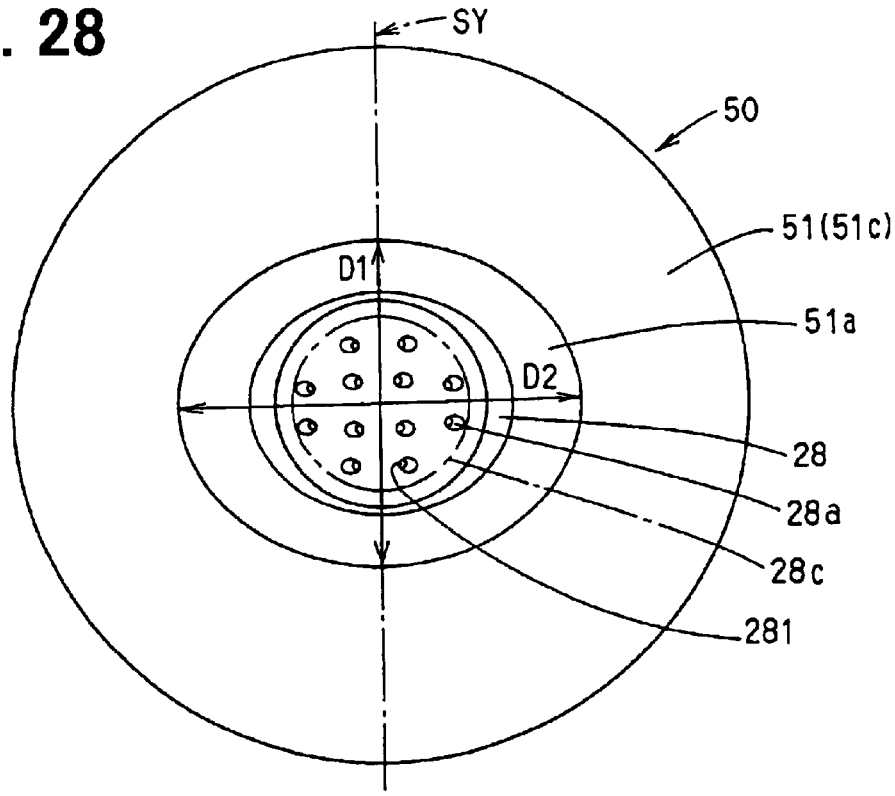
FIG. 28 is a plan view of a tip of the injector of the ninth embodiment.
Figure 29:
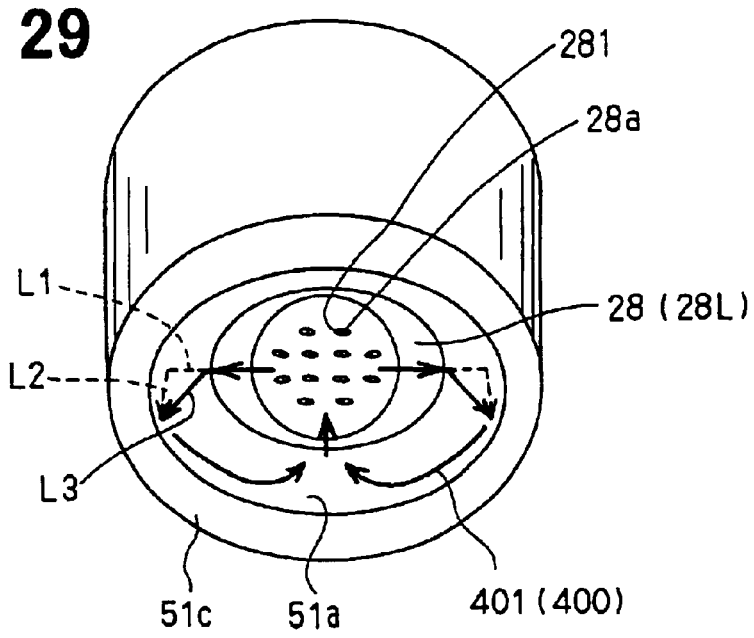
FIG. 29 is a perspective view of the tip of the injector of the ninth embodiment.

FIG. 27 is a sectional view showing a tip portion of an injector according to a ninth embodiment of the present invention. FIG. 28 is a plan view of the injector illustrated in FIG. 27 as seen in XXVIII direction. FIG. 29 is a perspective view of a tip of the injector.

In this embodiment, a cylindrical portion 50 has a radially thicker annular wall 51 than in the other embodiments. The annular wall 51 defines an elliptic opening portion 50*a*. Besides, the opening portion 50*a* is divergent from an orifice plate 28 downstream. Thus, an inner periphery surface 51*a* is funnel-like. An inclination angle $\phi$ of the inner periphery surface 51*a* is maximum at a major diameter D2 and minimum at a minor diameter D1. In other words, the inclination angle $\phi$ becomes smaller with separation from a negative pressure forming section 200. As a result, it is possible to diminish the adhesion of fuel to a portion distant from the negative pressure forming section 200. In this embodiment it is possible to shorten the length of an adhered fuel flowing path 401. For example, in the case where the inclination angle of the inner periphery surface 51*a* is 90°, adhered fuel flows through paths L1 and L2. However, if the inner periphery surface 51*a* has an inclination angle of less than 90°, adhered fuel can flow through a path L3.

The path L3 is shorter than the sum of the lengths of both paths L1 and L2.

Tenth Embodiment

Figure 30:
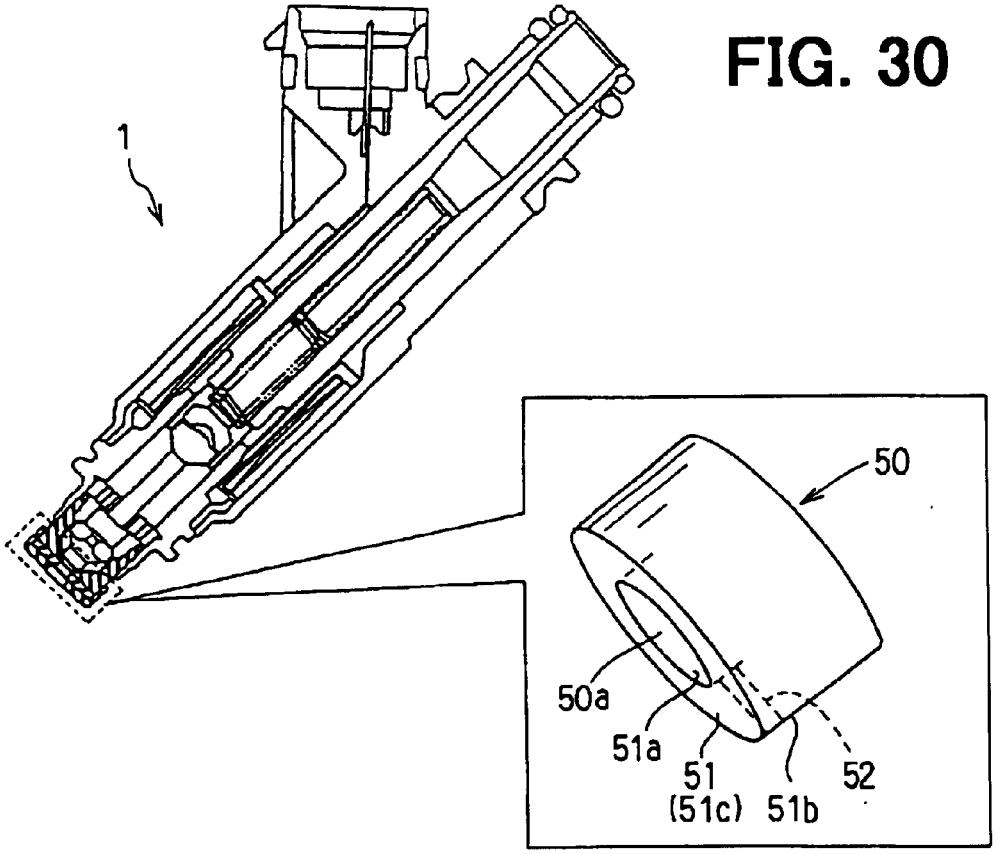
FIG. 30 is a sectional view of an injector according to a tenth embodiment of the present invention.

FIG. 30 is a sectional view of an injector according to a tenth embodiment of the present invention, showing a mounted state of the injector, indicated at 1. The vertical direction in FIG. 30 corresponds to the direction of gravity. Within a frame in FIG. 30 there is illustrated a cylindrical portion 50 on a larger scale. The cylindrical portion 50 has a single guide hole 52. In the mounted state shown in FIG. 30, the guide hole 52 is positioned on a lower side in the gravitational direction. The guide hole 52 is formed a portion of the cylindrical portion 50 located at the lowest position in the mounted state of the injector 1. Therefore, adhered fuel which is moving down by gravity can be recovered positively. According to this construction, the only one guide hole 52 permits the recovery of adhered fuel. In addition to the guide hole 52 located at the lowest position there may be formed another guide hole.

Eleventh Embodiment

Figure 31A:
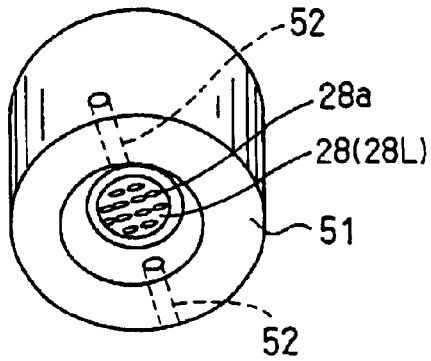
FIG. 31A is a perspective view of a tip of an injector according to an eleventh embodiment of the present invention.
Figure 31B:
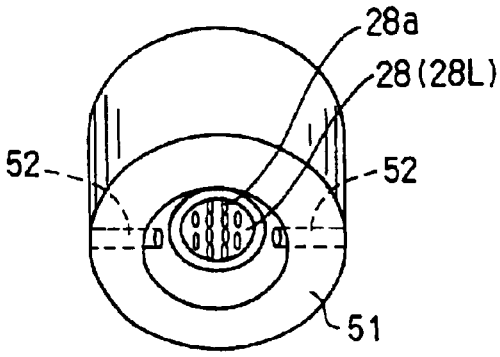
FIG. 31B is a perspective view of the tip of the injector of the eleventh embodiment.

FIG. 31A is a perspective view of a cylindrical portion 50 of an injector according to an eleventh embodiment of the present invention. FIG. 31B is also a perspective view of the cylindrical portion 50 of the injector of the eleventh embodiment. The injector of this embodiment has two guide holes 52 disposed on a diagonal line. The two guide holes 52 are sure to recover adhered fuel irrespective of a mounting angle of the injector. FIG. 31A shows a case in which an axis of the injection is inclined relative to the gravitational direction. One guide hole 52 is positioned lower than a horizontal diameter of the cylindrical portion. In this arrangement, adhered fuel which is flowing down by gravity is recovered efficiently by the lower guide hole 52. FIG. 31B shows an arrangement in which a pair of guide holes 52 are positioned horizontally. In this arrangement, the two guide holes 52 act equally and recover the adhered fuel. Three or more guide holes 52 may be provided. This is suitable for a structure wherein the injector 1 itself is rotated and is thereby mounted, for example, to an intake pipe of an engine. The two guide holes 52 recovers the adhered fuel efficiently also in the case where the injector 1 is mounted in an upright state.

Twelfth Embodiment

Figure 32:
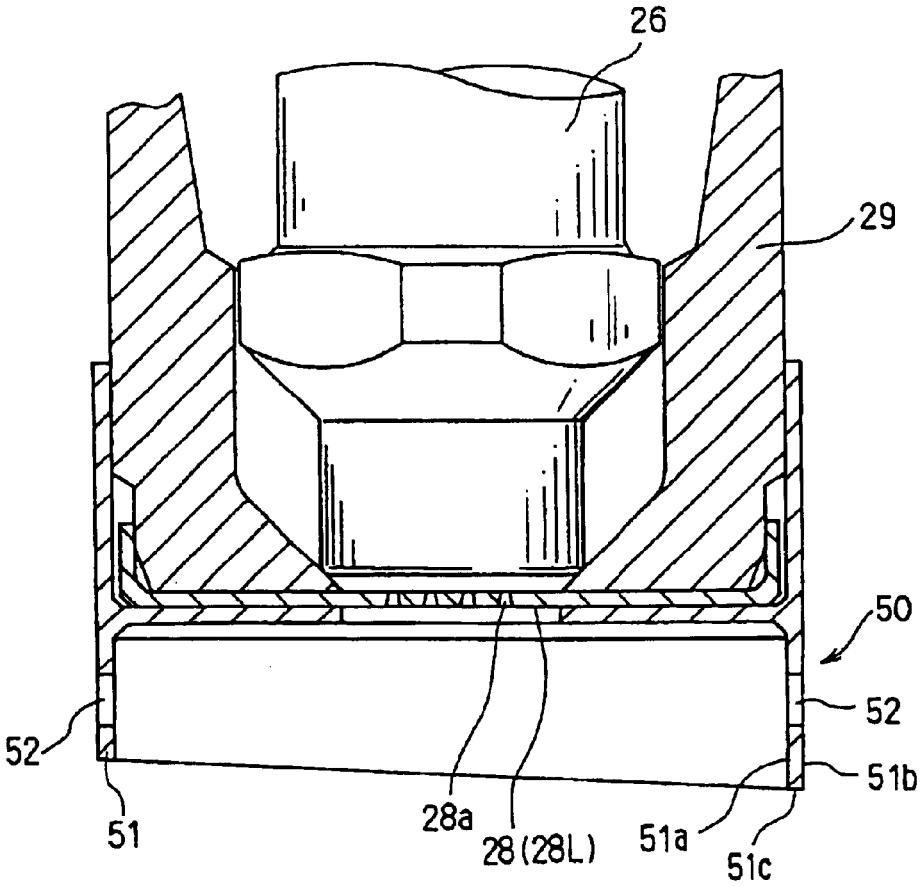
FIG. 32 is a sectional view of a tip portion of an injector according to a twelfth embodiment of the present invention.

FIG. 32 is a sectional view of a tip portion of an injector according to a twelfth embodiment of the present invention. In this embodiment, a cylindrical portion 50 has an annular wall 51. The annular wall 51 is formed with guide holes 52. The annular wall 51 is cylindrical, but a tip thereof is formed obliquely with respect to the axis of the injector. In FIG. 32, the annular wall 51 is low on the left-hand side and high on the right-hand side. In FIG. 32, therefore, a tip 51*c* extends downward to a greater extent on its right-hand side than on its left-hand side. Consequently, adhered fuel which has reached the tip 51*c* is easy to flow rightwards in FIG. 32. As a result, adhered fuel is collected into the right-hand guide hole 52 and is recovered. This construction is effective for recovering the adhered fuel efficiently in case of mounting the injector 1 in an upright state to, for example, an intake pipe of an engine. Particularly, the time required for the recovery of adhered fuel can be shortened in comparison with the case of having a tip orthogonal to the gravitational direction.

Thirteenth Embodiment

Figure 33:
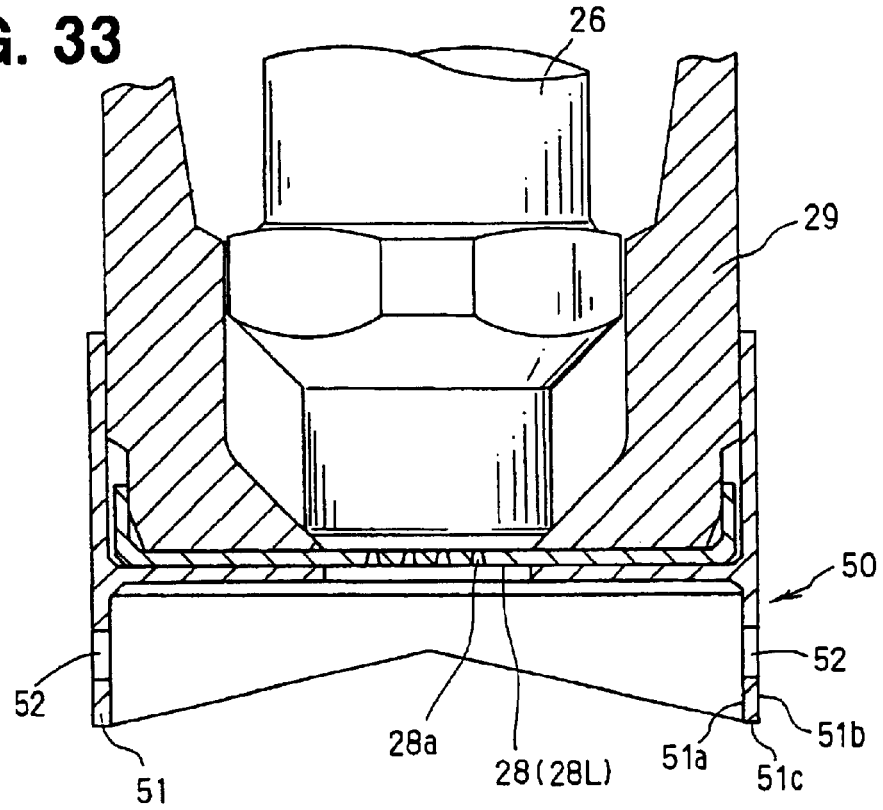
FIG. 33 is a sectional view of a tip portion of an injector according to a thirteenth embodiment of the present invention.

FIG. 33 is a sectional view of a tip portion of an injector according to a thirteenth embodiment of the present invention. In this embodiment, a tip of a cylindrical portion 50 is formed in an inverted M shape. In FIG. 33, an annular wall 51 becomes higher toward both sides from a central part. In the same figure, a tip 51*c* becomes lower toward both sides from the central part. Further, guide holes 52 are formed respectively in projecting portions located on both sides. According to this construction, adhered fuel can be collected efficiently in each of the two guide holes 52. It is possible to let both guide holes 52 fulfill their function to a satisfactory extent and thereby recover the adhered fuel.

Fourteenth Embodiment

Figure 34:
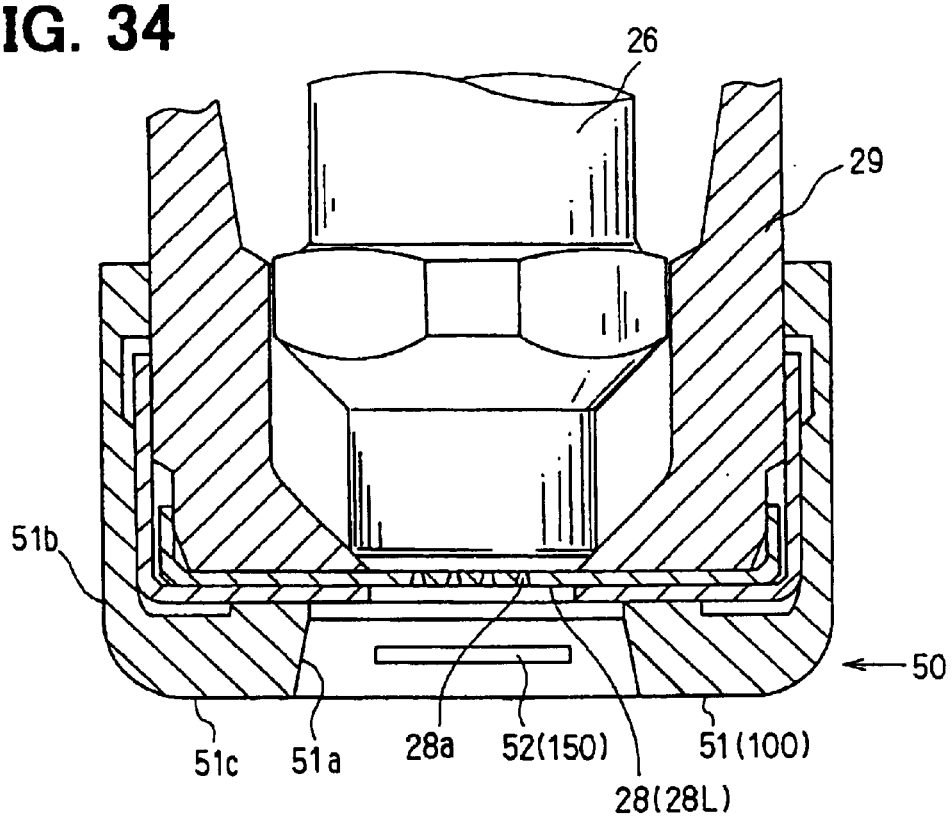
FIG. 34 is a sectional view of a tip portion of an injector according to a fourteenth embodiment of the present invention.

FIG. 34 is a sectional view of a tip portion of an injector according to a fourteenth embodiment of the present invention. In this embodiment, a cylindrical portion 50 has a thick annular wall 51 similar to that shown in FIG. 27. The annular wall 51 is provided with a guide hole 52 serving as a negative pressure introducing passage 150. The guide hole 52 has a rectangular section whose longitudinal direction is orthogonal to the axis of the injector. The guide hole 52 is formed in a slot shape and provides an elongated opening in the circumferential direction of the injector 1. The guide hole 52 is flat in a direction parallel to an orifice plate 28. The slot-like guide hole 52 facilitates the flow of adhered fuel onto a lower surface 28L of the orifice plate 28. In case of obtaining the same opening area, the rectangular guide hole 52 provides a larger outer periphery length in comparison with a circular hole. In other words, the rectangular guide hole 52 can afford a wider surface area on its inner periphery than a circular guide hole. As a result, it is possible to increase the flow velocity at an inner surface of the guide hole 52. Besides, since a relatively wide surface area can be obtained, clogging is difficult to occur even if combustion products are deposited. Due to spit-back which occurs depending on engine operating conditions, combustion products reach the tip of the injector and are deposited thereon. With the guide hole 52 used in this embodiment, the injector performance can be maintained in a satisfactory state over a long period even if combustion products are deposited.

Fifteenth Embodiment

Figure 35A:
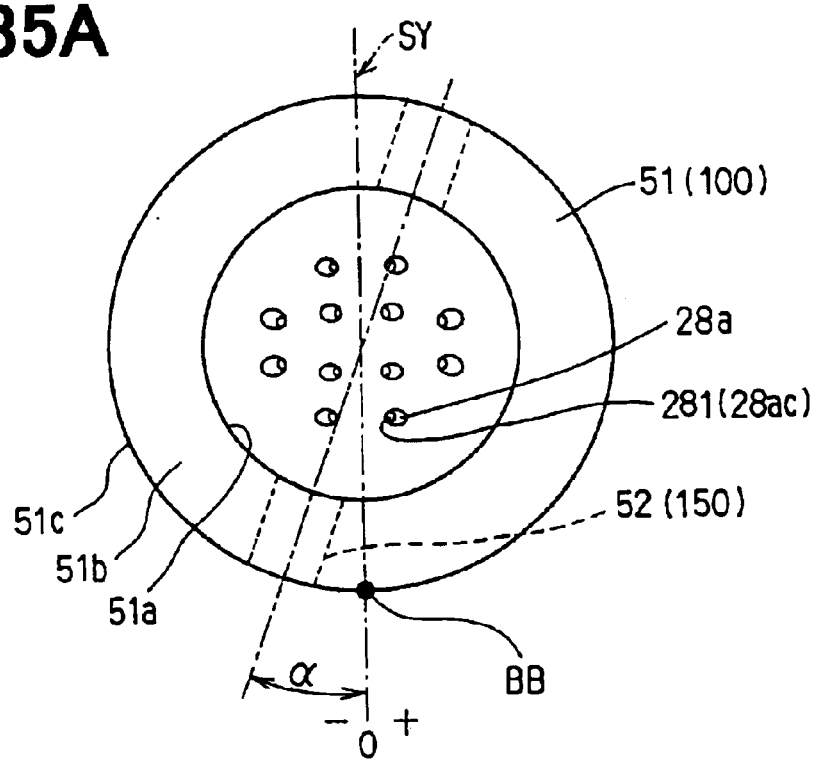
FIG. 35A is a plan view of a tip of an injector according to a fifteenth embodiment of the present invention.
Figure 35B:
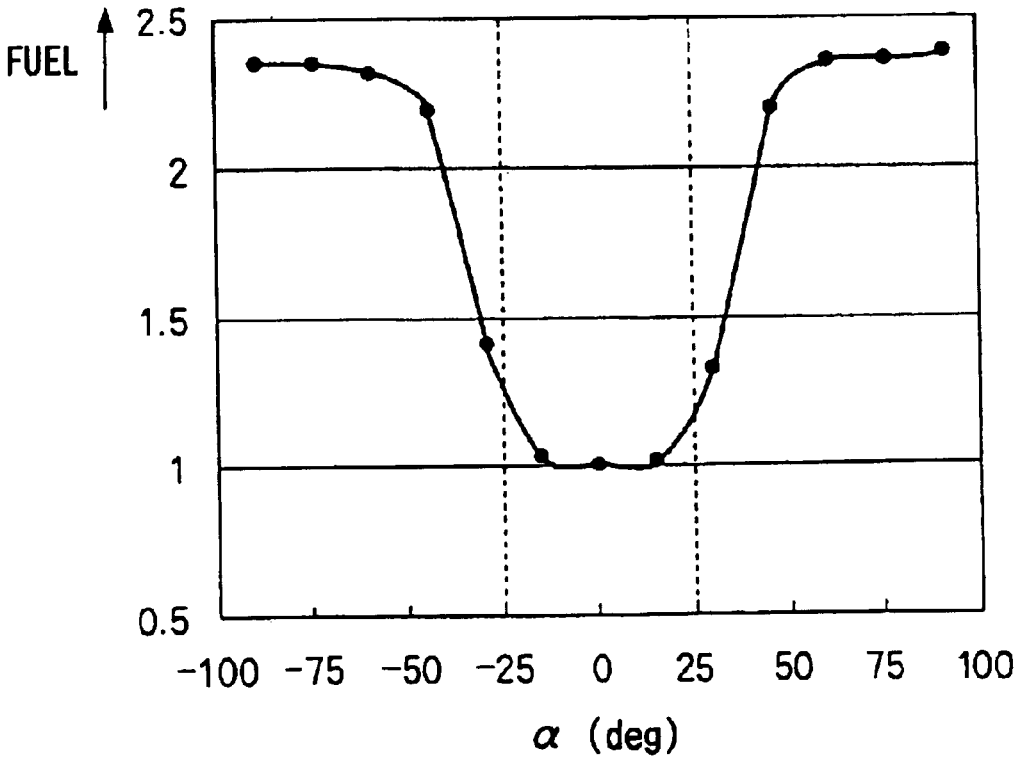
FIG. 35B is a graph showing a relation between angle $\alpha$ and the amount of adhered fuel.

FIG. 35A is a plan view of a tip of an injector according to a fifteenth embodiment of the present invention. In this embodiment, two guide holes are disposed on a diameter. It is desirable that the guide holes 52 be positioned on an axis SY of an orifice plate 28. However, the position of the guide holes 52 is deviated from the axis SY due to, for example, an error in an assembling process. In FIG. 35A there is illustrated an angle $\alpha$ between the axis SY of the orifice plate 28 and each guide hole 52. As shown in FIG. 35A, the axis SY is positioned vertically. A bottom point BB is a point which assumes the lowest position when the injector 1 is mounted in an inclined state with respect to the engine. FIG. 35B is a graph showing a relation between the mounting angle $\alpha$ and the amount of adhered fuel in such a state where the injector is mounted to be inclined as in FIG. 30. The amount of adhered fuel is shown in terms of ratio, assuming that the ratio is 1 when the mounting angle $\alpha$ is 0°. According to this embodiment, the positioning of the guide holes 52 is performed at a relatively rough accuracy. Although a rough positioning gives rise to variations in the mounting angle $\alpha$, a desired object can be achieved by setting the mounting angle $\alpha$ within a predetermined certain range. In this embodiment, the cylindrical portion 50 is mounted so that the mounting angle $\alpha$ falls under a range of ±25°. As shown in FIG. 35B, the amount of adhered fuel varies depending on the mounting angle $\alpha$, but within the range of ±25° it is possible to prevent an excessive increase of the adhered fuel.

The graph of FIG. 35B includes both an influence of a negative pressure which is developed relatively strongly on the axis SY and an influence of gravity imposed on the adhered fuel. A certain or higher negative pressure occurs over the whole outer circumference of a lower surface 28L of the orifice plate 28 and therefore the graph of FIG. 35B reflects the influence of gravity strongly. The same characteristic as in FIG. 35B is obtained also in an injector not provided with negative pressure introducing passages 150. For example, the same characteristic is obtained in the use of such an elliptic annular wall 51 as shown in FIG. 21 or FIG. 28. In the case of the elliptic annular wall 51, its minor diameter is disposed within the range of ±25° from the bottom point BB in the circumferential direction of the injector. Therefore, also in the embodiment illustrated in FIG. 21 or FIG. 28, even if the positioning of the cylindrical portion 50 is performed roughly, the amount of adhered fuel can be kept at a certain level or lower by keeping the range.

Sixteenth Embodiment

Figure 36A:
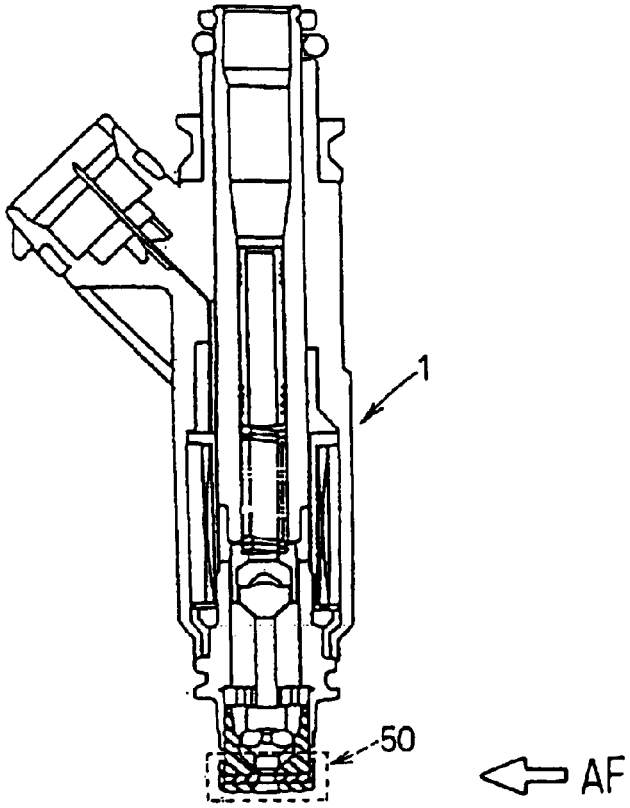
FIG. 36A is a sectional view of an injector according to a sixteenth embodiment of the present invention.
Figure 36B:
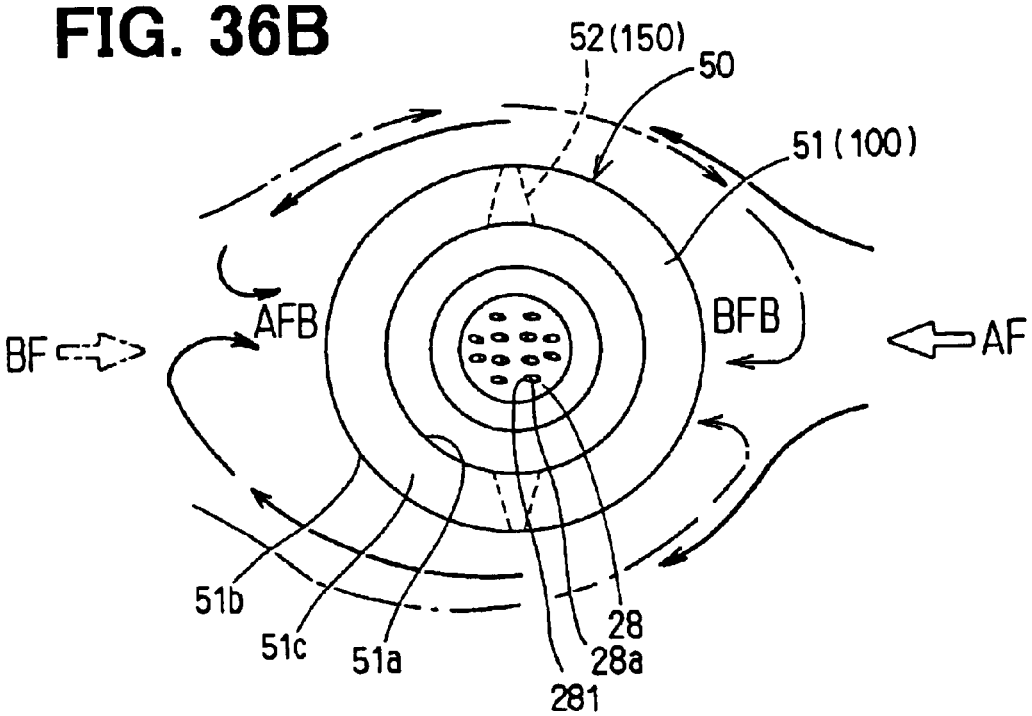
FIG. 36B is a plan view of a tip of the injection of the sixteenth embodiment.

FIG. 36A is a sectional view of an injector according to a sixteenth embodiment of the present invention. FIG. 36B is a plan view of the injector of FIG. 36A as seen from below. In FIGS. 36A and 36B, an intake air flow AF in an engine is shown with a solid line arrow. In FIG. 36B, a spit-back air flow BF from the engine is shown with a dot-dash line arrow. In this embodiment, guide holes 52 are disposed so as to traverse the intake air flow AF within the intake passage. In FIG. 36B, a pair of guide holes 52 are arranged in a direction orthogonal to the intake air flow AF. Since the injector 1 is disposed to project into the intake passage, stagnant regions AFB and BFB are formed around a tip portion of the injector. In this embodiment the guide holes 52 are not directly influenced by the air flow AF or BF, so that the recovery of adhered fuel is promoted. Further, since the guide holes 52 do not face the stagnant regions AFB and BFB, it is possible to diminish the deposition of adhered fuel in the guide holes 52.

Seventeenth Embodiment

Figure 37:
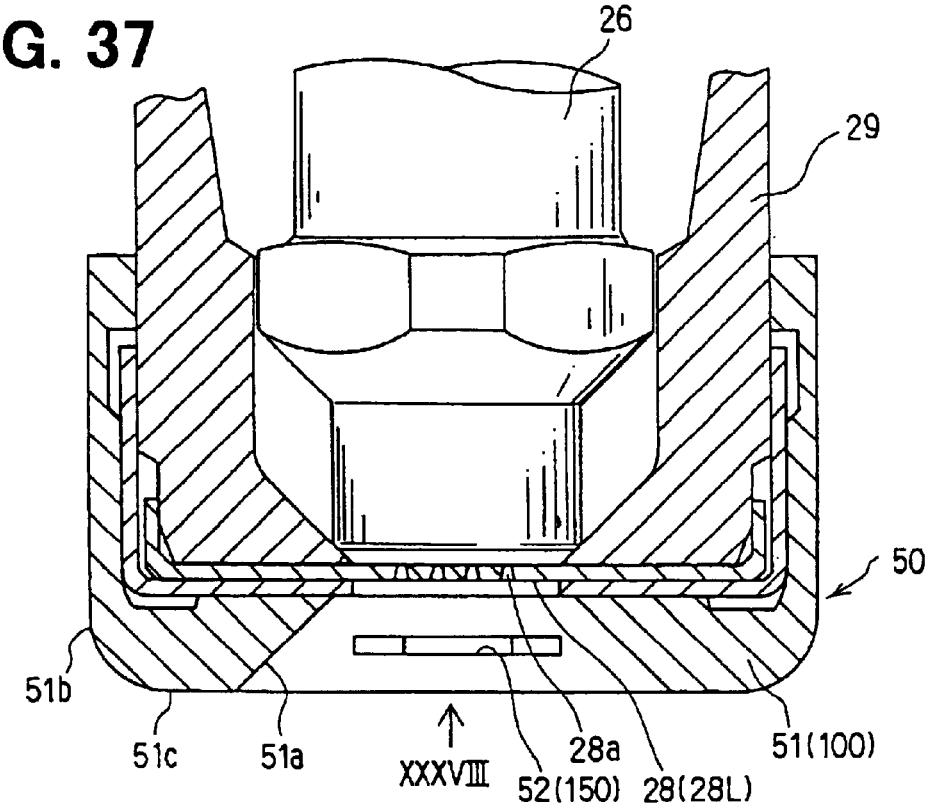
FIG. 37 is a sectional view of a tip portion of an injector according to a seventeenth embodiment of the present invention.
Figure 38:
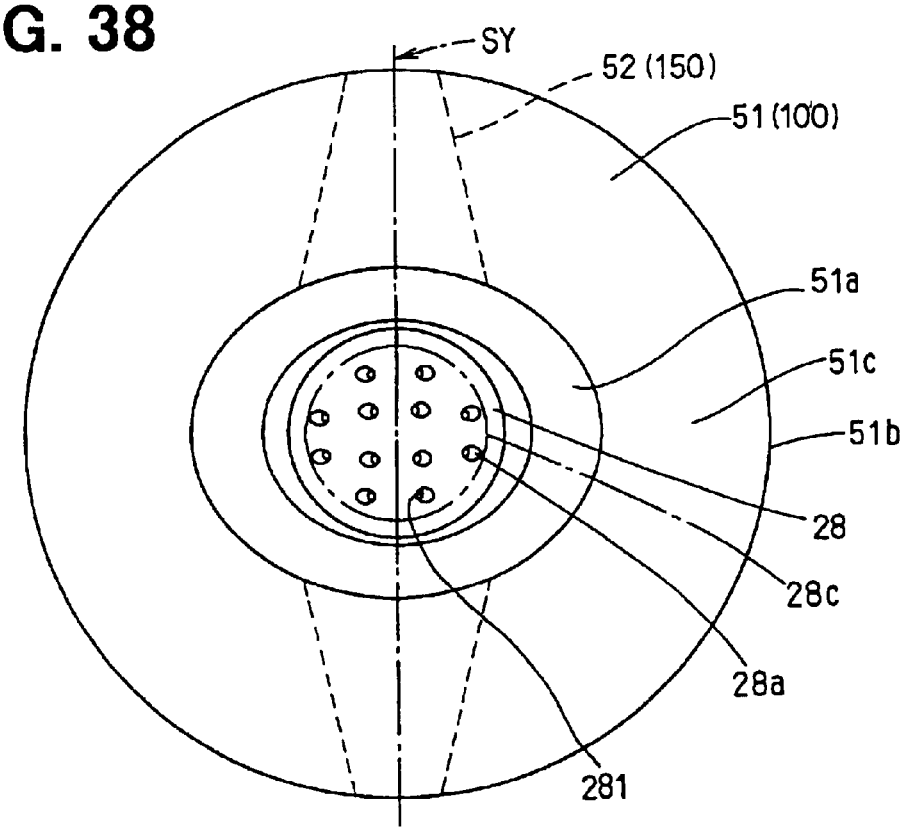
FIG. 38 is a plan view of a tip of the injector of the seventeenth embodiment.
Figure 39:
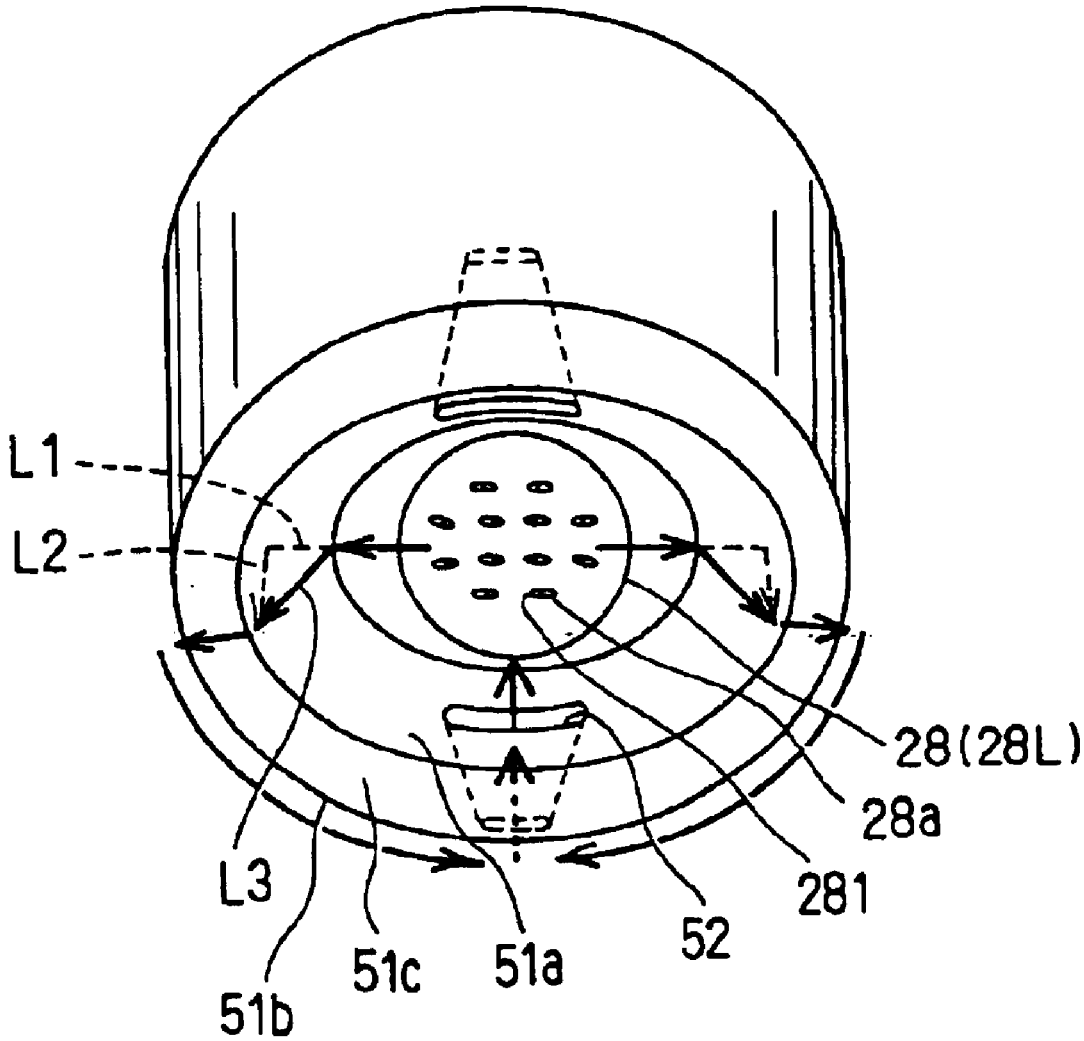
FIG. 39 is a perspective view of the tip of the injector of the seventeenth embodiment.

FIG. 37 is a sectional view of a tip portion of an injector according to a seventeenth embodiment of the present invention. FIG. 38 is a plan view of FIG. 37 as seen in XXXVIII direction. FIG. 39 is a perspective view of a tip of the injector. In the seventeenth embodiment, a guide hole 52 is added to the embodiment illustrated in FIGS. 28 and 29. A cylindrical portion 50 is a protective member made of resin. This protective member 50 protects portions which have been machined with a high precision, including an orifice plate 28. The guide hole 52 has a rectangular section and its area becomes gradually smaller radially outwards.

Eighteenth Embodiment

FIG. 40 is a plan view of a tip of an injector according to an eighteenth embodiment of the present invention. In this embodiment, plural orifices 28*a* are arranged to be axisymmetric with respect to an axis SY. The plural orifices 28*a* are arranged in the shape of a single ring, i.e., a ring of only one row. Also in this construction a negative pressure forming section 200 can be formed so as to traverse an orifice plate 28 diametrically along the axis SY.

Nineteenth Embodiment

FIG. 41 is a plan view of a tip of a projector according to a nineteenth embodiment of the present invention. In this embodiment, plural orifices 28*a* are arranged asymmetrically with respect to an axis SY. However, the same number of orifices are arranged on both sides of the axis SY. The orifices 28*a* arranged on the right-hand side of the axis SY are inclined rightwards, while the orifices 28*a* arranged on the left-hand side of the axis SY are inclined leftwards. For example, six orifice axes (28*j*1, 28*j*2, . . . , 28*ji*) positioned on the right-hand side of the axis SY are inclined away from the axis SY. Also in this embodiment a negative pressure forming section 200 can be formed so as to traverse an orifice plate 28 diametrically along the axis SY.

Twentieth Embodiment

FIG. 42 is a plan view of a tip of an injector according to a twentieth embodiment of the present invention.

In this embodiment, plural orifices 28*a* are arranged asymmetrically with respect to an axis SY. Besides, the number of orifices is different between the right and left sides of the axis SY. An add number of orifices are arranged on the right-hand side of the axis SY, while an even number of orifices are arranged on the left-hand side. Also in this embodiment a negative pressure forming section 200 can be formed so as to traverse an orifice plate 28 diametrically along the axis SY. In this embodiment, the plural orifices 28*a* are arranged on straight lines parallel to the axis SY. Consequently, a strong negative pressure can be generated from end to end along the axis SY.

Twenty-first Embodiment

FIG. 43 is a plan view of a tip of an injector according to a twenty-first embodiment of the present invention. In this embodiment, plural orifices 28*a* are arranged symmetrically with respect to an axis SY. In this embodiment, plural orifices 28*a* arranged radially outwards are larger in size than plural orifices arranged inside. Also in this embodiment a negative pressure forming section 200 can be formed so as to traverse an orifice plate 28 diametrically along the axis SY.

Twenty-second Embodiment

Figure 44:
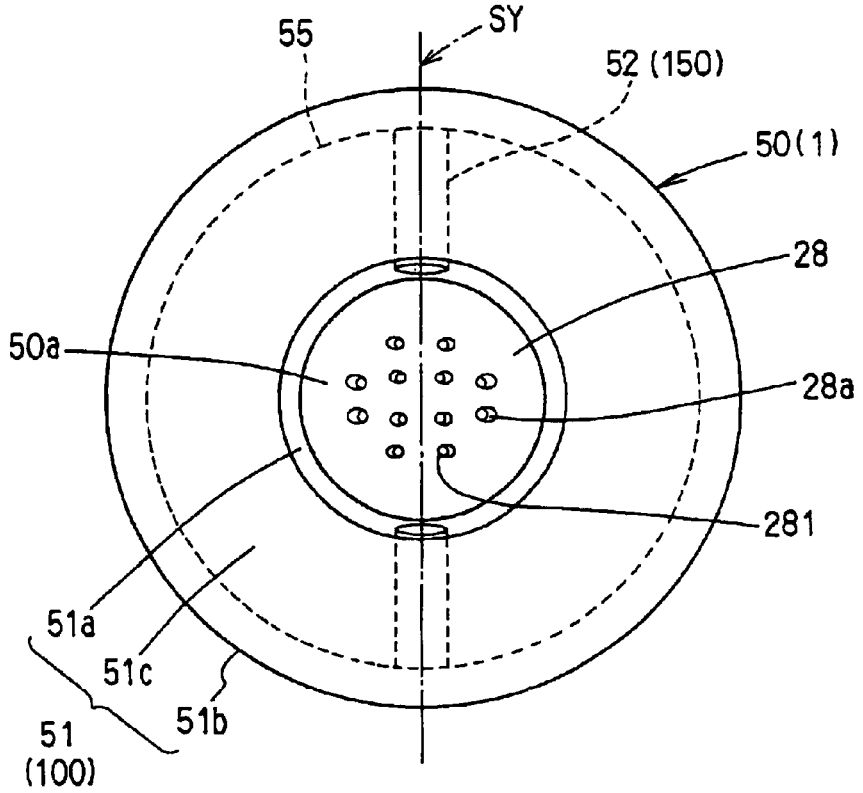
FIG. 44 is a plan view of a tip of an injector according to a twenty-second embodiment of the present invention.
Figure 45:
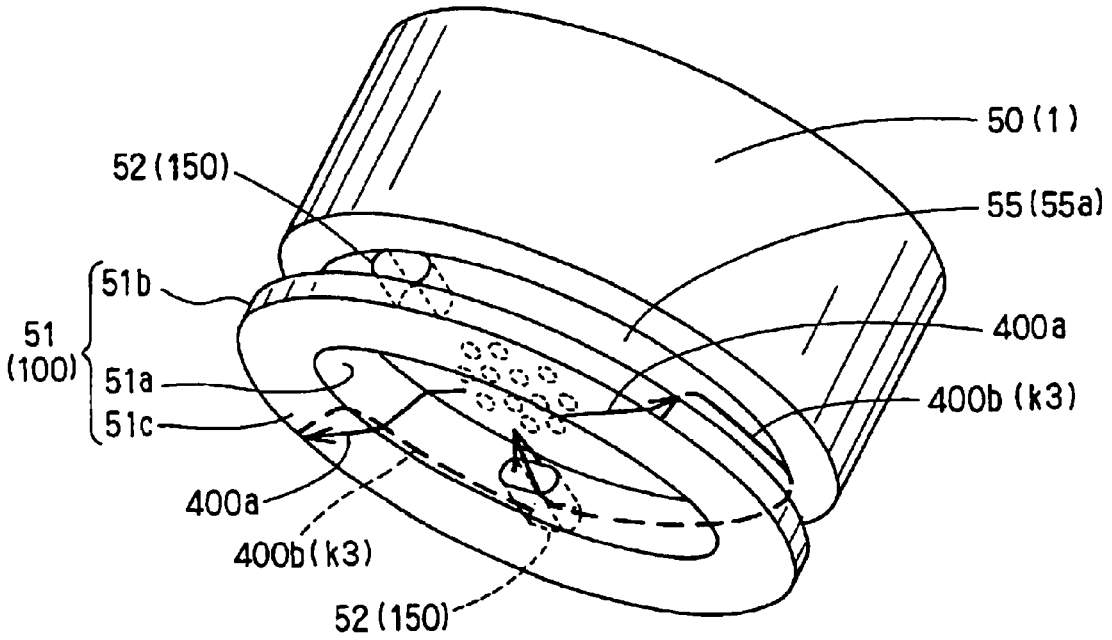
FIG. 45 is a perspective view of the tip of the injector of the twenty-second embodiment.
Figure 46:
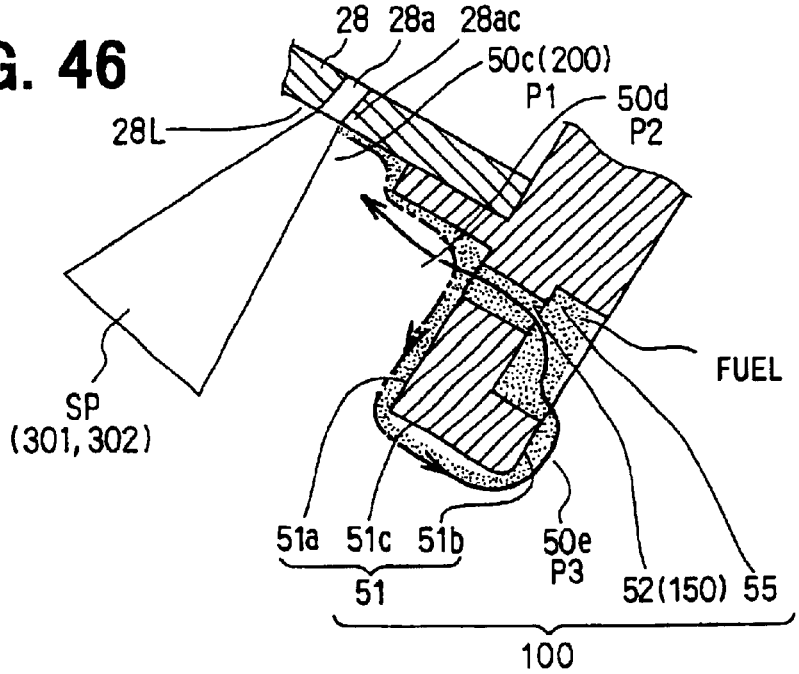
FIG. 46 is a partially enlarged sectional view showing a radial section of the injector of the twenty-second embodiment.
Figure 47A:
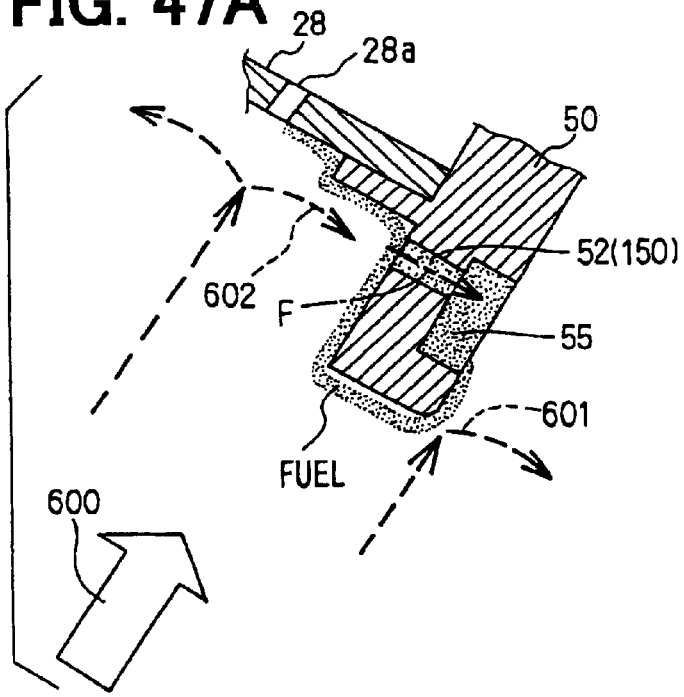
FIG. 47A is a partially enlarged sectional view showing a radial section of the injector of the twenty-second embodiment.
Figure 47B:
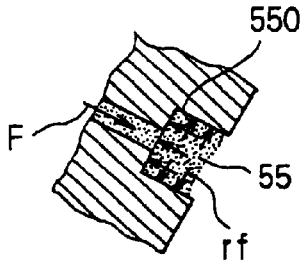
FIG. 47B is a partially enlarged sectional view showing a radial section of the injector of the twenty-second embodiment.
Figure 47C:
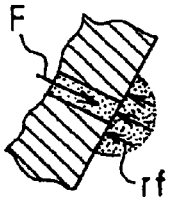
FIG. 47C is a partially enlarged sectional view showing a radial section of an injector as a comparative example.

FIG. 44 is a plan view of a tip of an injector according to a twenty-second embodiment of the present invention. FIG. 45 is a perspective view of the injector tip in a mounted state of the injector. FIG. 46 is a partially enlarged sectional view showing a radial section of the injector tip. FIG. 47A is a partially enlarged sectional view also showing a radial section of the injector tip. FIG. 47B is a partially enlarged sectional view further showing a radial section of the injector tip. FIG. 47C is a partially enlarged sectional view showing a radial section of a comparative injector.

In this embodiment, as shown in FIGS. 44 and 45, a slot 55 which extends circumferentially is formed in an outer periphery surface 51*b* of an annular wall 51. The annular wall 51 has guide holes 52 which are open to a bottom 55*a* of the slot 55. The slot 55 is a square slot having the bottom and both side faces. In this embodiment, adhered fuel which has flowed radially outwards along a path 400*a* is caught by the slot 55, then flows through the slot 55 toward the guide holes 52. At this time, the adhered fuel flows not only under the influence of an air flow induced by a negative pressure but also under the influence of gravity. The slot 55 not only catches the adhered fuel but also is effective in shortening the distance of an adhered fuel path 400*b*. Further, the slot 55 prevents scattering of the adhered fuel from the annular wall 51. Since the slot 55 forms a concave and a convex on the outer periphery surface 51*b*, it increases a surface area to which fuel can adhere. As a result, adhered fuel adheres strongly to the slot 55 by virtue of its own surface tension and hence becomes difficult to be blown off by an air flow. For example, a spit-back phenomenon in an engine gives rise to an intake flow 600 in a direction opposite to the direction of fuel injection in the injector 1. The intake flow 600 induces an air flow 601 acting directly on the fuel adhered to the outer periphery surface 51*b* and an air flow 602 which strikes against an orifice plate 28 and acts to push out the adhered fuel present within the guide holes 52. In this embodiment, the adhered fuel present within the slot 55 exhibits a surface tension rf capable of withstanding a spit-back force F based on the air flow 602. FIG. 47B shows the surface tension rf in the presence of the slot 55, while FIG. 47C shows the surface tension rf in the absence of the slot 55.

Twenty-third Embodiment

Figure 48:
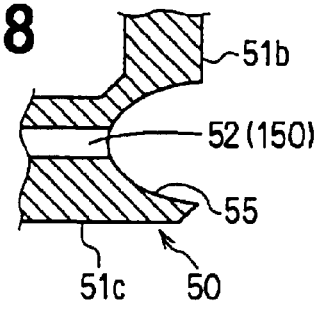
FIG. 48 is a partially enlarged sectional view showing a radial section of an injector according to twenty-third embodiment of the present invention.

FIG. 48 is a partially enlarged sectional view showing a radial section of a tip of an injector according to a twenty-third embodiment of the present invention. In this embodiment, a slot 55 of a U-shaped section is formed in an outer periphery surface 51*b*. Machining of the U-shaped slot is easy.

Twenty-fourth Embodiment

Figure 49:
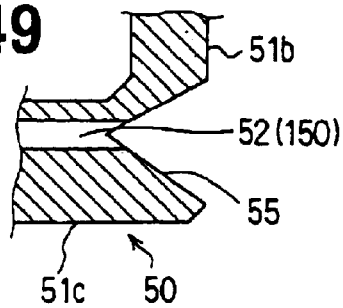
FIG. 49 is a partially enlarged sectional view showing a radial section of an injector according to a twenty-fourth embodiment of the present invention.

FIG. 49 is a partially enlarged sectional view showing a radial section of a tip of an injector according to a twenty-fourth embodiment of the present invention. In this embodiment, a slot 55 of a V-shaped section is formed in an outer periphery surface 51*b*. Machining of the v-shaped slot is easy.

Twenty-fifth Embodiment

Figure 50:
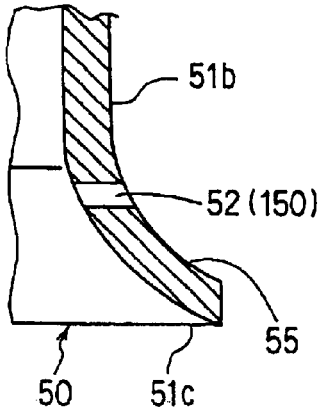
FIG. 50 is a partially enlarged sectional view showing a radial section of an injector according to a twenty-fifth embodiment of the present invention.

FIG. 50 is a partially enlarged sectional view showing a radial section of a tip of an injector according to a twenty-fifth embodiment of the present invention. In this embodiment, a cylindrical portion 50 is divergent radially outwards toward a tip 51*c*. As a result, the cylindrical portion 50 assumes a curved shape. As a whole, the cylindrical portion 50 is in the shape of a bell mouth. A half slot 55 is formed in an outer periphery surface 51*b* of the cylindrical portion 50. The bell mouth-shaped cylindrical portion 50 does not obstruct the direction and spread of a fuel spray. Further, the bell mouth-shaped cylindrical portion 50 fulfills an umbrella-like function for diminishing the influence of an air flow 601 on adhered fuel. As a result, scattering of the adhered fuel from the outer periphery surface 51*b* is prevented.

Twenty-sixth Embodiment

Figure 51:
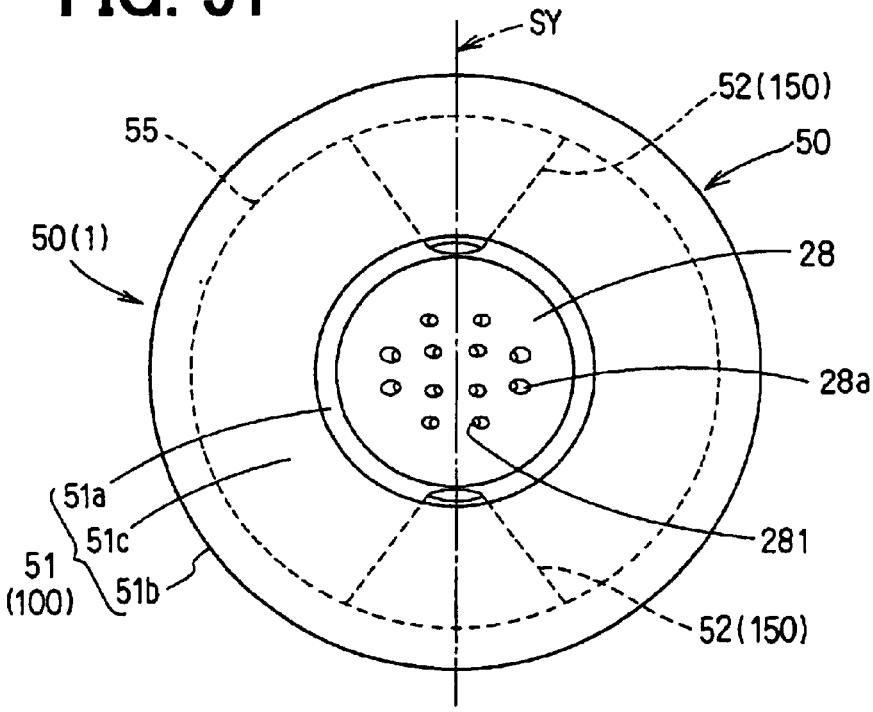
FIG. 51 is a plan view of a tip of an injector according to a twenty-sixth embodiment of the present invention.

FIG. 51 is a plan view of a tip of an injector according to a twenty-sixth embodiment of the present invention. In this embodiment, guide holes 52 are each formed by a flat elongated hole and are each divergent radially outwards. As a result, an opening portion of each guide hole 52 located on an inner periphery 51*a* side can be made small and an opening area expands toward an outer periphery 51*b* side, so that a spit-back force F can be dispersed. Consequently, it is possible to prevent scattering of adhered fuel from the guide holes 52. The guide holes may be of a circular section. By allowing the guide holes of a circular section to be divergent radially outwards, the spit-back force F can be dispersed.

Twenty-seventh Embodiment

Figure 52:
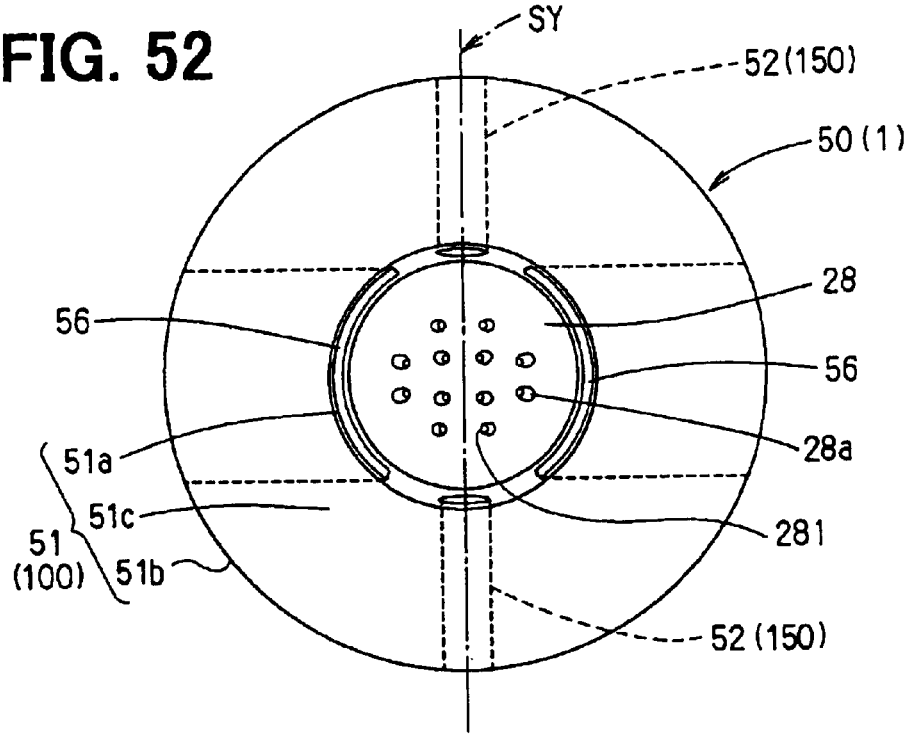
FIG. 52 is a plan view of the tip of the injector of the twenty-sixth embodiment.
Figure 53:
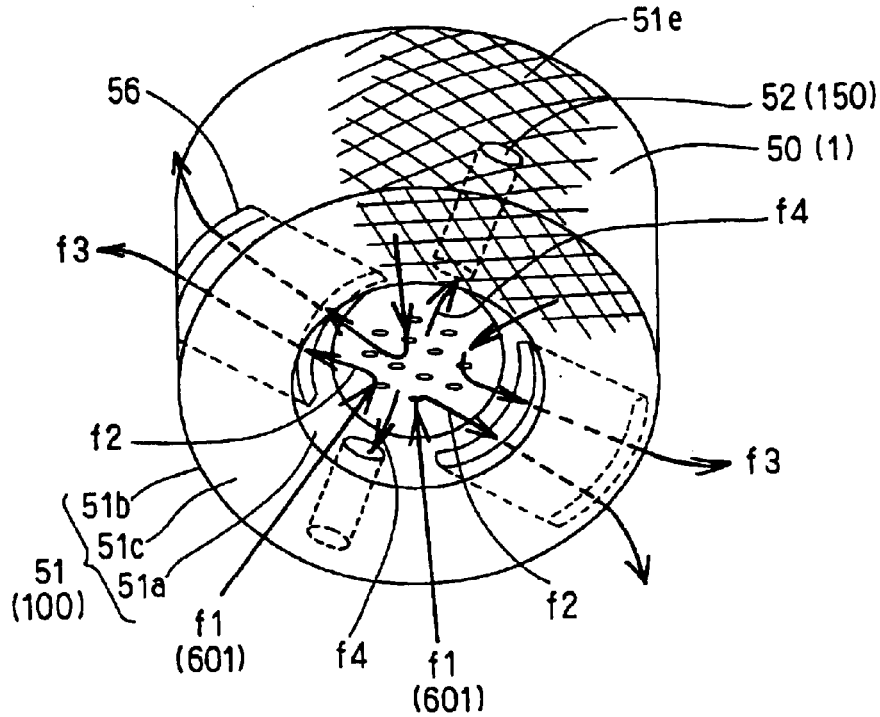
FIG. 53 is a perspective view of a tip of an injector according to a twenty-seventh embodiment of the present invention.

FIG. 52 is a plan view of a tip of an injector according to a twenty-seventh embodiment of the present invention. FIG. 53 is a perspective view of the injector tip. In this embodiment, air flow passages 56 having a flat passage section are formed in a cylindrical portion 50.

The air flow passages 56 extend perpendicularly to guide holes 52. When the injection of fuel from the injector is stopped, there may occur an air flow 601 toward the injector. In this embodiment, most of an air flow f1 passes as air flows f2 and f3 through the air flow passages 56. A portion of the air flow f1 becomes air flows f4 passing through the guide holes 52, but the amount of air flows f4 is small, so it is possible to suppress the scatter of adhered fuel from the guide holes 52. It is desirable that an opening area of each air flow passage 56 be large in comparison with the guide holes 52. As a result, the amount of air passing through the air flow passages 56 is sure to become larger than that of air passing through the guide holes 52. In this embodiment, moreover, plural concaves and convexes are formed on both outer periphery surface 51*b* and tip end face 51*c* of the cylindrical portion 50. The plural concaves and convexes are constituted by knurls 51*e*. The knurls 51*e* assist holding the adhered fuel and prevent the adhered fuel from falling as drops. Plural dimples may be formed on the outer periphery surface 51*b*.

In this embodiment, the air flow passages 56 intersects the axis of the injector perpendicularly and extend in parallel with the surface of an orifice plate 28. However, the air flow passages 56 may be formed to be inclined with respect to the orifice plate 28. According to this construction, it is possible to let the air flows f3 have directionality. For example, it is desirable to form air flow passages so as not to obstruct the flow of adhered fuel toward a negative pressure forming section 200.

Twenty-eighth Embodiment

Figure 54:
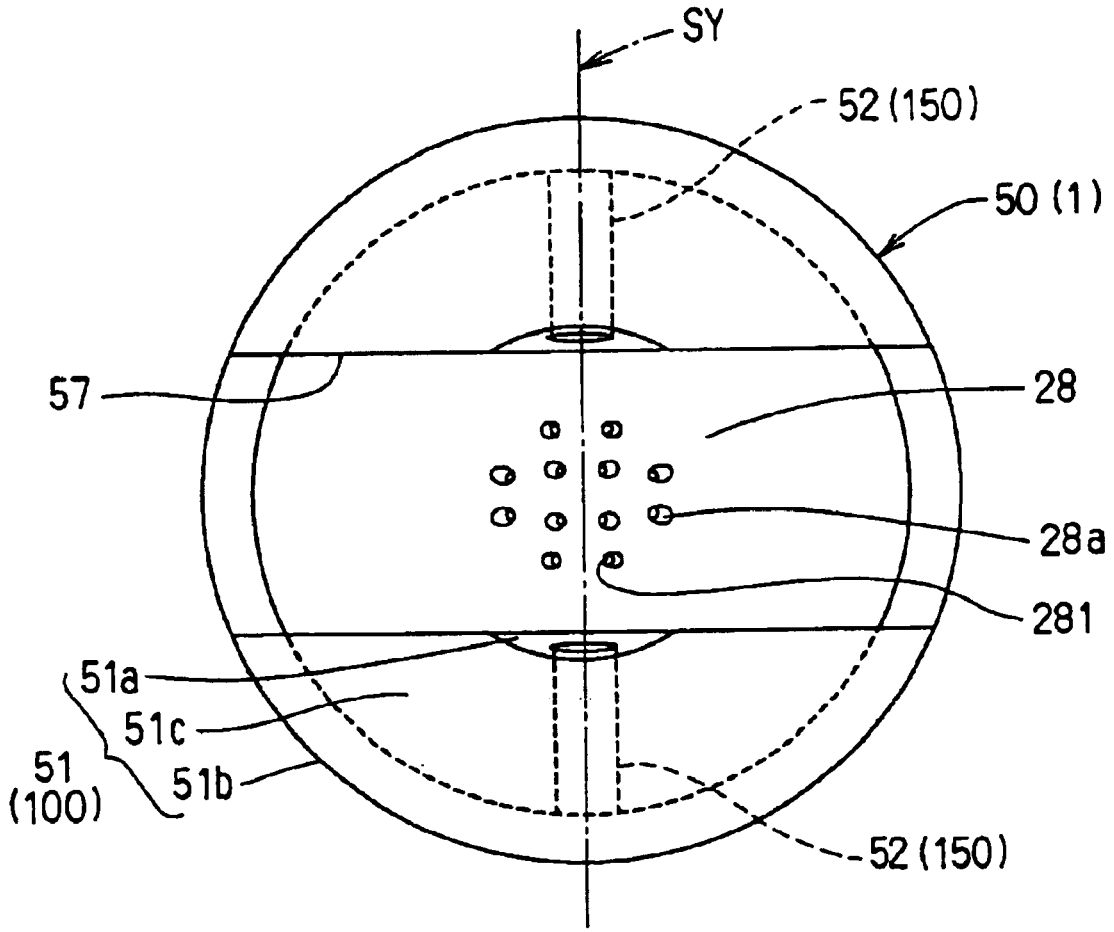
FIG. 54 is a plan view of a tip of an injector according to a twenty-eighth embodiment of the present invention.
Figure 55:
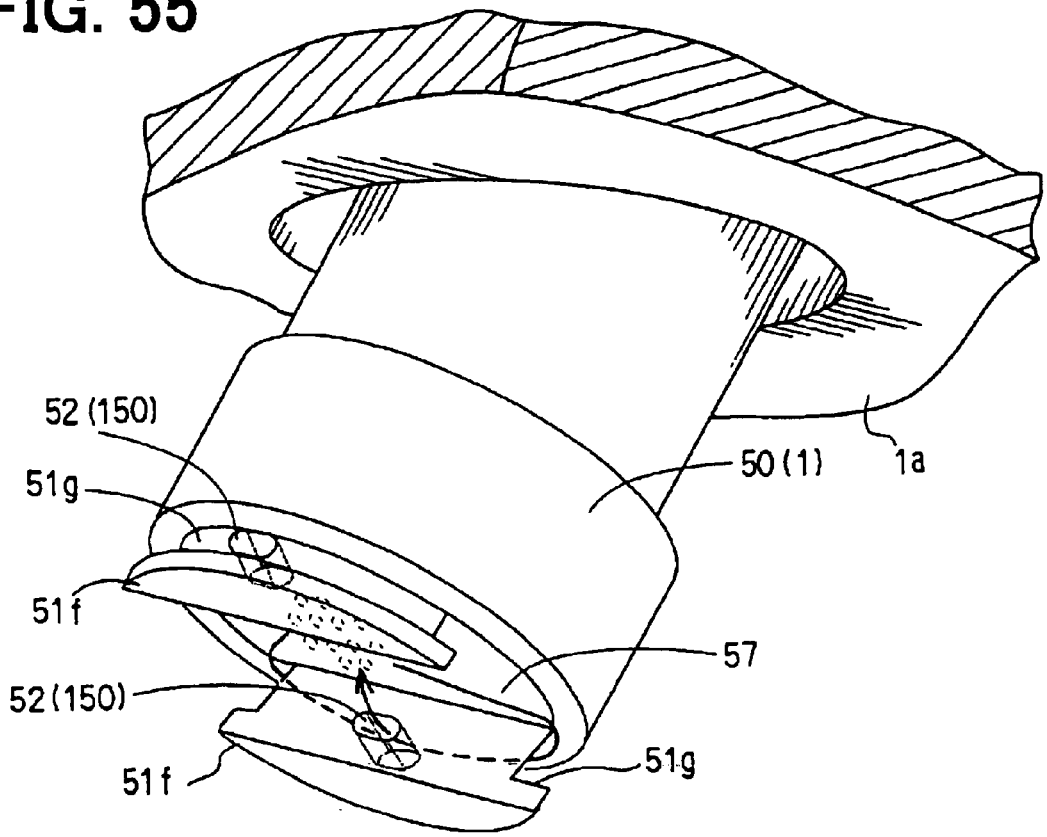
FIG. 55 is a perspective view of the tip of the injector of the twenty-eighth embodiment.

FIG. 54 is a plan view of a tip of an injector according to a twenty-eighth embodiment of the present invention. FIG. 55 illustrates a vertical relation in a mounted state of the injector 1 to an intake pipe. As shown in FIG. 55, the injector 1 is disposed in a downwardly projected state from the interior of an intake pipe 1*a*. A cylindrical portion 50 has a pair of walls 51*f* on upper and lower sides, respectively, of a tip of the injector 1. Each wall 51*f* has a flat surface on an inside and a slot 51*g* on an outside and is further provided with a guide hole 52. The guide hole 52 is in a flat shape parallel to the surface of the orifice plate 28 and is slit-like. A slot 57 serving as an air flow passage is formed in a tip portion of the cylindrical portion 50. The slot 57 extends horizontally in the mounted state of the injector 1. The injector 1 forms two-way fuel sprays in the extending direction of the slot 57.

Adhered fuel concentrates at the tip of the injector 1, particularly on the lower side. In this embodiment, the walls 51*f* are provided as catch members to catch the adhered fuel. The wall 51*f* located on the lower side prevents the adhered fuel from falling as a drop.

Paths for causing the adhered fuel to flow toward an orifice plate 28 are formed by the surfaces of the walls 51*f* and the guide holes 52 formed therein. Slots 55 are formed respectively in outer periphery surfaces of the walls 51*f* to collect the adhered fuel into the guide holes 52. The guide holes 52 are positioned on an axis SY and point to between orifices which form a spray in a first direction and orifices which form a spray in a second direction. The fuel adhered to the lower wall 51*f* is sucked in through the associated guide hole 52 onto a lower surface 28L of the orifice plate 28, then joins a fuel jet injected from the orifices 28*a* and is injected again. Thus, the walls 51*f* return the adhered fuel onto the orifice plate 28. Consequently, the adhered fuel is prevented from stagnating in such a large quantity as forms a drop. Falling of the adhered fuel as a drop is also prevented.

Since the injector 1 is disposed so that an axis 1*j* thereof is inclined from a vertical axis, the walls 51*f* are located on a lower side with respect to the axis 1*j*. Further, since the walls 51*f* are not positioned in the spraying direction, they do not obstruct the spray.

In this embodiment, a large opening can be ensured as an air flow passage. Further, the pair of walls 51*f* are effective in shortening the adhered fuel flowing path.

According to the shape adopted in this embodiment, the amount of adhered fuel can be decreased by providing at least the wall 51*f* located on the lower side.

In this embodiment, the orifice plate 28 is made of stainless steel and the cylindrical portion 50 is made of resin. The cylindrical portion may be made of copper which is superior in thermal conductivity to stainless steel. Copper promotes the rise in temperature of the cylindrical portion 50 and also promotes the evaporation of adhered fuel. Likewise, the orifice plate 28 may be formed using a material low in thermal conductivity such as a ceramic material and the cylindrical portion may be formed using a material superior in thermal conductivity to the ceramic material.

Plural orifices formed in the orifice plate may be arranged so as to form a conical spray in one direction or sprays in three directions. Whichever direction, one or three directions, the spraying direction may be, the adhered fuel can be returned to the spray(s) by utilizing a negative pressure formed on the orifice plate.

Twenty-ninth Embodiment

Figure 56:
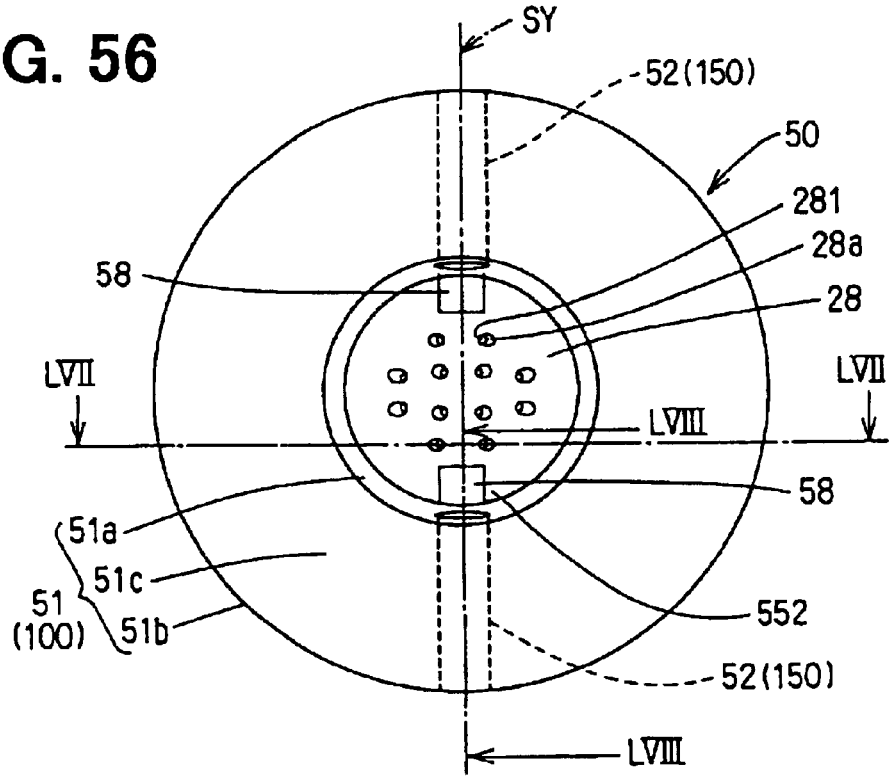
FIG. 56 is a plan view of a tip of an injector according to a twenty-ninth embodiment of the present invention.
Figure 57:
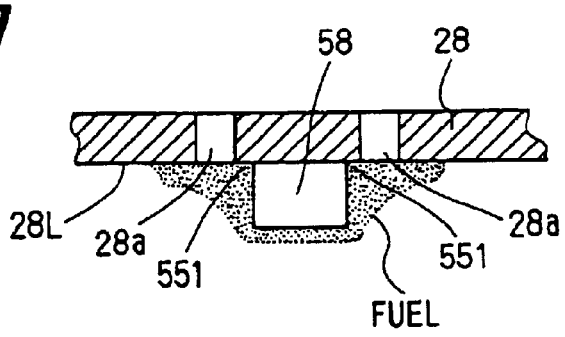
FIG. 57 is a partially enlarged sectional view taken on line LVII—LVII in FIG. 56 of the injector of the twenty-ninth embodiment.
Figure 58:
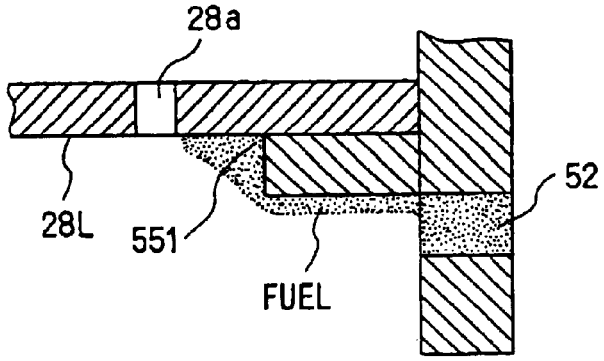
FIG. 58 is a partially enlarged sectional view taken on line LVII—LVII in FIG. 56 of the injector of the twenty-ninth embodiment.

FIG. 56 is a plan view of a tip of an injector according to a twenty-ninth embodiment of the present invention. FIGS. 57 and 58 are sectional views of FIG. 56. In this embodiment, lugs 58 are formed on an extension line of guide holes 52. As shown in FIG. 56, the lugs 58 extend radially upward of an orifice plate 28 along an axis SY from the guide holes 52. As shown in FIG. 58, the height of each lug 58 is about the same as an edge on the orifice plate 28 side of each guide hole 52. The lugs 58 are formed on an inner periphery surface 51*a* so as to abut a lower surface 28L of the orifice plate 28. The lugs 58 form concave portions 551 at boundary portions with the orifice plate 28. The lugs 58 also form concave portions 552 between them and the inner periphery surface 51*a*. As shown in FIGS. 57 and 58, adhered fuel is apt to stay in the concave portions 551 and 552. As shown in both figures, fuel adheres around the lugs 58 and is guided onto the orifice plate 28. Thus, the adhered fuel can be guided to near orifices 28*a*. Besides, since the concave portions 551 and 552 hold the adhered fuel in the vicinity of the orifices 28*a*, the adhered fuel becomes easier to flow under the action of a negative pressure and also becomes easier to join a fuel jet injected from the orifices 28*a*. Further, even if the inner periphery wall 51*a* is spaced apart from the orifices 28*a*, the adhered fuel can be guided to near the orifices.

Thirtieth Embodiment

Figure 59:
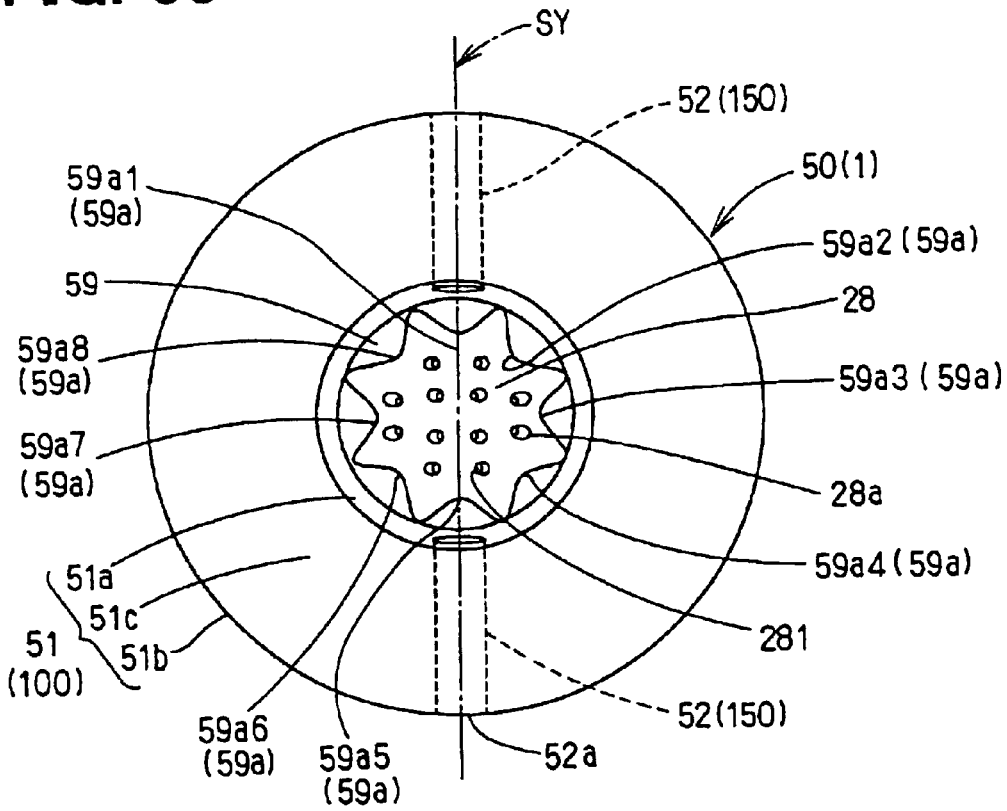
FIG. 59 is a plan view of a tip of an injector according to a thirtieth embodiment of the present invention.

FIG. 59 is a plan view of a tip of an injector according to a thirtieth embodiment of the present invention. In this embodiment, a projection member 59 is disposed on an inner periphery surface 51*a* instead of the lugs 58. The projection member 59 is formed in a corrugated shape and has eight projections 59*a*1 to 59*a*8. In this embodiment, the projections 59*a*1 and 59*a*5 are positioned on an axis of symmetry SY and on an extension of guide holes 52. The projection member 59 is easy to be aligned with an orifice plate 28. Besides, adhered fuel is guided onto a lower surface 28L of the orifice plate from plural radially outside positions of the orifice plate 28. Further, a negative pressure developed on the lower surface 28L of the orifice plate 28 can be utilized throughout the whole circumference to return the adhered fuel.

In this embodiment, a porous material 52*a* is provided in the interior of each guide hole 52. The porous material 52*a* prevents the deposition of combustion products and catches adhered fuel by capillarity. Therefore, it is possible to prevent scattering of adhered fuel. The porous material may be provided on only the inner surfaces of the guide holes 52.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. An injector in which an orifice plate having a plurality of orifices disposed in an outlet of a fuel passage formed at a tip portion of a valve body and fuel is injected from the orifices, thereby weighing the fuel and determining a direction of injection, the injector comprising:

a negative pressure forming section formed near and downstream the orifice plate by the fuel injected from the orifices; and a recovery means which guides adhered fuel by utilizing a negative pressure developed in the negative pressure forming section and which forms a flow of the adhered fuel advancing toward outlets of the orifices.

2. An injector according to claim 1, wherein an axis of each of the orifices is inclined with respect to a valve stem.

3. An injector according to claim 1, wherein the orifices are arranged in plural rows or in plural rings in a lower surface of the orifice plate.

4. An injector according to claim 1, wherein the orifices are arranged to be axisymmetric in the orifice plate.

5. An injector according to claim 1, wherein the recovery means is extended downstream of a lower surface of the orifice plate and is provided with a wall disposed outside and near a circumscribed circle of outlet-side openings of the plural orifices.

6. An injector according to claim 5, wherein a plurality of concaves and convexes are formed on an outer surface of the wall.

7. An injector according to claim 5, wherein an inside of the wall is in the shape of an ellipse.

8. An injector according to claim 7, wherein a minor diameter of the ellipse is positioned within the range of ±25° in the circumferential direction of the injector from a bottom point of the injector with a state where the injector is mounted on and inclined to an engine.

9. An injector according to claim 5, wherein an inside of the wall is divergent from the lower surface of the orifice plate downstream of fuel injection.

10. An injector according to claim 9 wherein the inside of the wall is divergent with separation from the negative pressure forming section.

11. An injector according to claim 5, wherein the wall is provided with an inner periphery surface positioned radially inside and an outer periphery surface positioned radially outside.

12. An injector according claim 11 wherein the outer periphery surface of the wall projects downstream of the wall.

13. An injector according to claim 11, wherein a gap is formed between the inner and outer periphery surfaces of the wall and a negative pressure introducing passage for radially conducting the negative pressure developed in the negative pressure forming section is formed in the inner periphery surface of the wall.

14. An injector according to claim 5, wherein the wall has a curvedly divergent shape toward the downstream side.

15. An injector according to claim 5, wherein a tip end face of the wall is inclined from a plane orthogonal to an axis of the injector.

16. An injector according to claim 5, wherein the wall is provided with a negative pressure introducing passage for radially conducting a negative pressure developed in the negative pressure forming section.

17. An injector according to claim 16, wherein the negative pressure introducing passage is a guide hole extending radially through the wall.

18. An injector according to claim 17, wherein the guide hole is tapered radially outwards.

19. An injector according to claim 17, wherein the guide hole is a circumferentially elongated hole.

20. An injector according to claim 17, wherein the guide hole is divergent radially outwards.

21. An injector according to claim 16, wherein the negative pressure introducing passage is a slot formed in the wall and extending radially.

22. An injector according to claim 16, wherein the interior of the negative pressure introducing passage is porous.

23. An injector according to claim 16, wherein an air flow passage extending radially through the wall is formed in the wall separately from the negative pressure introducing passage.

24. An injector according to claim 23, wherein the air flow passage is an air flow passage hole defined by an opening larger than the negative pressure introducing passage.

25. An injector according to claim 23, wherein the air flow passage is a slot formed in a lower surface of the wall and extending radially.

26. An injector according to claim 23, wherein the air flow passage is inclined with respect to the orifice plate.

27. An injector according to claim 16, wherein a tip of the wall is inclined so as to gradually extend downward toward the negative pressure introducing passage.

28. An injector according to claim 16, wherein the negative pressure introducing passage is positioned within the range of ±25° in the circumferential direction of the injector from a bottom point of the injector in a state where the injector is mounted on and inclined to an engine.

29. An injector according to claim 16, wherein the negative pressure introducing passage is disposed in a direction intersecting an intake air flowing direction in an engine with the injector mounted thereon.

30. An injector according to claim 5, wherein a circumferentially extending passage slot is formed on the outer periphery side of the wall.

31. An injector according to claim 1, wherein at least one lug extending radially toward a central part of the orifice plate is formed inside the wall.

32. An injector according to claim 31, wherein the at least one lug is disposed so as to abut the lower surface of the orifice plate.

33. An injector according to claim 31, wherein the at least one lug is disposed so as to extend in an extending direction of the negative pressure forming section on the orifice plate.

34. An injector according to claim 33, wherein a plurality of lugs are formed inside the wall.

35. An injector according to claim 1, wherein the recovery means is constituted by a protective member extended downstream of a lower surface of the orifice plate.

36. An injector according to claim 35, wherein the projective member has a thermal conductivity higher than that of the orifice plate.

37. An injector for fuel injection, comprising:

an orifice plate disposed at a tip of the injector and formed with an orifice for fuel injection;

a catch member disposed radially outwards of the orifice to catch fuel adhered to the tip of the injector; and a path formed by the catch member to let the adhered fuel caught by the catch member flow onto the orifice plate, wherein a passage extending from a position where the adhered fuel accumulates up to a position near the orifice plate is formed in the catch member, the passage constituting at least a part of the path.

38. An injector according to claim 37, wherein the catch member has a wall member positioned radially outwards of the orifice and extending in a fuel injecting direction from the orifice plate.

39. An injector according to claim 38, wherein the catch member has a slot for collecting the adhered fuel into the passage.

40. An injector according to claim 38, wherein the catch member is disposed below an axis of the injector.

41. An injector according to claim 38, wherein the catch member has a cylindrical portion disposed radially outwards of the orifice plate.

42. An injector according to claim 38, wherein the orifice comprises a plurality of orifices for forming sprays in at least two directions, and the passage is directed toward between a first orifice for forming a spray in a first direction and a second orifice for forming a spray in a second direction.

43. An injector according to claim 38, wherein the passage is a hole extending through the wall member.

44. An injector according to claim 38, wherein the passage is flat in a direction parallel to a surface of the orifice plate.

* * * * *